US005396413A

United States Patent [19]

Kaneko et al.

[11] Patent Number: 5,396,413

[45] Date of Patent: Mar. 7, 1995

[54] METHOD OF CONTROLLING AMENITY PRODUCTS OR ROTATING MACHINES

[75] Inventors: Hisao Kaneko; Makoto Oda, both of Yokohama; Shigeharu Nakano, Hitachi; Yukio Obata, Yokohama, all of Japan

[73] Assignee: Hitachi, Ltd., Tokyo, Japan

[21] Appl. No.: 4,113

[22] Filed: Jan. 13, 1993

[30] Foreign Application Priority Data

Jan. 13, 1992 [JP] Japan ..... 4-003433
Mar. 13, 1992 [JP] Japan ..... 4-054911

[51] Int. Cl.[6] ..... G05B 11/01; D06F 33/00

[52] U.S. Cl. ..... 364/140; 364/142; 364/143; 68/12.02

[58] Field of Search ..... 364/140, 142, 143, 146, 364/172, 174; 68/12.01, 12.02

[56] References Cited

U.S. PATENT DOCUMENTS

| | | | |
|---|---|---|---|
| 3,914,107 | 10/1975 | Ellis | 364/143 |
| 3,937,981 | 2/1976 | Nystuen et al. | 364/143 |
| 4,084,237 | 4/1978 | Beachem et al. | 364/143 |
| 4,184,347 | 1/1980 | Tobita et al. | 364/144 |
| 4,245,309 | 1/1981 | Kiefer | 364/146 |

FOREIGN PATENT DOCUMENTS

| | | |
|---|---|---|
| 57-5599 | 1/1982 | Japan . |
| 61-56805 | 12/1986 | Japan . |
| 2286194 | 11/1990 | Japan . |
| 496794 | 3/1992 | Japan . |

OTHER PUBLICATIONS

Ikuo Matsuba: "Chaos and Forecast", Mathematics and Science, No. 348, pp. 64–69, Jun. 1992. (no English translation).

Tohru Ikeguchi, et al.: "A Dimensional Analysis on Chaotic Neutral Networks", Journal of Institute of Electronics, Communication and Information Engineers of Japan, A vol. J73–A, No. 3, pp. 486–494, Mar. 1990. (no English translation).

Tetsunori Kobayashi et al.: "Relation Between Fractal Dimension of Fluctuations in Fundamental Period and Naturality of Speech", Papers on Conference of Acoustics Society of Japan, pp. 361–362, Mar. 1992. (no English translation).

*Primary Examiner*—Paul P. Gordon
*Attorney, Agent, or Firm*—Antonelli, Terry, Stout & Kraus

[57] ABSTRACT

Fractal operation is applied to motion of amenity products or rotating machines within a practical range and motion close to a natural phenomenon is realized by doing it. For example, a washing machine is structured so as to realize washing close to that of washing by hand. Control parameters are given to the control unit regularly and recursively by a fundamental rule and the processing is iterated. Furthermore, at least one of the control parameters is reduced, in which the reduction is effected gradually in accordance with a reduction rate and in which at least one of the reduction rate, the dimension of recursive iteration, and the number of times of self-similar iteration is given as a pseudo random number which varies within a predetermined range.

29 Claims, 26 Drawing Sheets

BEST AVAILABLE COPY
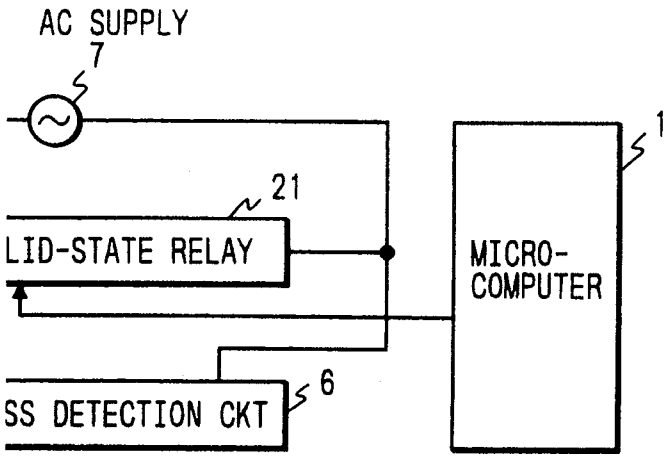
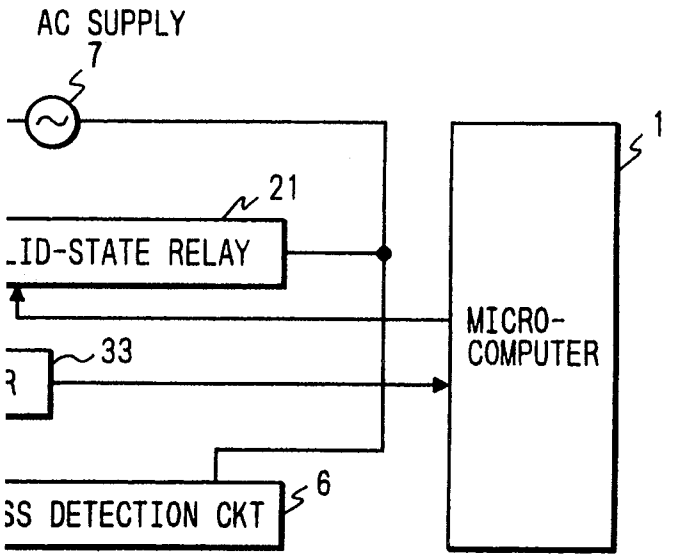

METHOD OF CONTROLLING AMENITY PRODUCTS OR ROTATING MACHINES

BACKGROUND OF THE INVENTION

The present invention relates to a control method or unit for amenity products, which pertain predominantly to human beings, and living things, via media such as fluid, and an amount of stimulation, on the basis of recognition of the following:

(1) Human beings and living things feel comfortable in a more natural environment and state.

(2) Natural things are useful.

(3) Products using nature in forming such as art objects, living tools, and cooking and handmade things are highly evaluated or highly efficient.

More specifically, the invention relates to a control method or unit for rotating machines, particularly to a control unit for agitating fluid or fine particles. Actual examples of machines are a washing machine, clothes drier, electric fan, air conditioning machines such as an air conditioner, ventilating fan, air cleaner, smell generator, fan heater, bubble massage bath, massager, refrigerator, rotating machine for a thawing box, massager as a vibrating apparatus, audio systems, foot warmer with a quilt over it and electronic carpet using a heat source as stationary machines, ultraviolet health device using a light source, and hothouse gardening equipment, Furthermore, the present invention relates to a control method or unit for rotating machines which are applied to or mounted in a jet-type, whirlpool-type, agitated-type, or drum-type electric washing machine and in a tumbler type electric clothes dryer, particularly, to a control method or unit for rotating machines for a washing machine and drier which are suited towards improvement of the washing and drying performance.

An example of a conventional control unit that an irregular data system is provided for operating an amount of physical stimulation and a comfortable feeling is obtained by irregularly changing the stimulation according to it is indicated in Japanese Patent Publication 61-56805.

Furthermore, fluctuation of an irregular signal is reported in, for example, Saji, "Comfortable Space Physics", Applied Physics, Vol. 60, No. 3, 1991. Particularly, it is described in the report that the 1/f fluctuation wherein the power spectrum is proportional to the reciprocal of the frequency is often observed in natural phenomena and is a comfortable stimulation pattern. (1/f noise is described in the paper of J. B. Jonson in 1925.)

An example of an electric fan for producing a current of comfortable air is indicated in the above report. The following method is used.

(1) A signal source for 1/f fluctuation is prepared.

(2) Time series data is sampled from the signal source, converted to control data, and stored in the memory.

(3) The number of revolutions and hold time therefor are controlled on the basis of the stored data.

An example of an electric fan in which the fan motor is continuously operated by changing the rotation speed via a plurality of steps and an operation pattern having a combination of operation and stop is iterated in a predetermined cycle by an intermittent operation means so as to change the power of a current of air obtained is described in Japanese Patent Application Laid-Open No. 57-5599.

Furthermore, the operation control method for a conventional washing machine is described in, for example, Yoshida and other four persons, "Clothes Washing and Drying Art and Application", Mitsubishi Denki Engineering Report, Vol. 62, No. 4, p. 8, 1988.

It is described in the report that as a method for increasing the washing capacity independently of twisting and tangling of clothes and the load amount, an operation control method for detecting the rotation status of the agitator by a pilot generator mounted to the motor, controlling the forward or reverse rotation of the motor, rotating the agitator back and forth, stopping current supply to the motor when the agitator rotates at a predetermined angle (forced rotation angle), and rotating the agitator reversely when it almost stops is effective. Furthermore, it is described in the report that it is also necessary for washing to minimize damaging of clothes and uneven washing, free of twisting and tangling of clothes.

Furthermore, a method in which the rotation angle of the agitator is made unbalanced by providing different current supply times for forward rotation and reverse rotation of the motor in the early stage of washing so as to allow water to penetrate fully into washing during the period of time is described in Japanese Patent Application Laid-Open No. 2-286194.

The aforementioned prior art has a concept that a natural phenomenon is based on an irregular signal or noise. Therefore, to realize a natural phenomenon or comfortable stimulation pattern, at least the time series data sampled from the signal source of irregular signals and a special memory for storing this data are required. Therefore, to obtain continuous changes like a natural phenomenon, the system scale increases and the cost goes up.

Furthermore, in the aforementioned scheme, the operation associated with the electric fan is described as being iterated in a predetermined cycle and a periodic operation at a low frequency is just changed to strong or weak. FIGS. 21(*a*) and 21(*b*) show measured results of power fluctuation of a whizzing sound of the electric fan described in the aforementioned literature (Saji, "Comfortable Space Physics"). FIG. 21(*a*) shows measured data for a current of random air. In FIG. 21(*b*) wherein a method using a signal source for 1/f fluctuation is used, remarkable 1/f fluctuation is shown in the low frequency area of 0.1 Hz max. In the higher-frequency area, a linear spectrum is observed and no tendency depending on the frequency is shown. FIG. 22 shown in the above literature shows a measured result of power fluctuation of a brooklet sound which is a natural phenomenon. The tendency of 1/f continues at frequencies higher than 1 Hz, and frequency components increase extremely, and the spectrum is continuous.

The aforementioned prior art on a washing machine minimizes twisting and tangling of clothes and damaging of clothes in addition to the washing object of only removing stains and can process widely large things such as curtains and blankets and lingerie and wool products consisting of fine fibers. However, the washing effect is contrary to the above twisting and tangling of clothes and damaging of clothes, so that further improvement of the performance is required.

An object of the present invention is to bring the operation of amenity products closer to a natural phenomenon by a more practical and simple means by introducing a concept which is indicated by words of Fractal and Chaos, that is, that in a word, regularity is latent in a phenomenon which is seen as irregular at a glance.

However, a word of Fractal was created first by B. Manderubrot, 1924 to -) between 1975 and 1982. The origin of the word is Fractus which is a Latin adjective and Fractional and Fracture are derived from it. In other words, Fractal is almost similar to a concept that many large and small fragments are collected and used almost in the same way as "Recursive" for physical properties of a Figure. The theory is used as a technique for creating various natural scenes and shapes such as mountains, rivers, and clouds, and as a model for creating objects and substances such as trees and crystals, and as a simulation of various phenomena in the natural world.

Although Fractal is not strictly defined, it suggests that irregularity and unforecastability are not considered just as noise but to have an intrinsic law. Furthermore, it is becoming clear recently that an intrinsic law is hidden in complication of a natural phenomenon.

Fractal is characterized by a word of self-similarity or recursiveness. It has been considered that a complicated shape or phenomenon is created only by a complicated operation. However, even a very complicated structure can be created only by a comparatively simple operation and such a structure is called a fractal structure.

Although some structures and phenomena in the natural world are very regular like fern leaves and show the fractal structure, they cannot be made to correspond to the fractal structure. However, when a parameter is provided with a random amount which varies within a certain range, the structure of the natural world can be imitated very well. The above is described in the following references in detail.

1) Angoin, Nakalima, Nagae, "Simple Fractal", Kogakusha, Ltd.

2) Takayasu, What is "Fractal?", Diamond. Ltd.

3) Takayasu, "Fractal", Asakura Shoten

4) Takayasu, "Fractal Science", Asakura Shoten

5) Yamaguchi, "Chaos and Fractal", Kodansha, Ltd.

6) J. Gleick and others, translated by Takayasu and others, "Turbulent of Mirror", Diamond, Ltd.

7) J Gleick, "Chaos—Making a New Science", Pengin Books, N.Y., 1987.

The concept of Chaos suggests that the deterministic nonlinear system output can indicate behavior which is very complicated and unforecastable. This means that there are possibilities that clear deterministic dynamics exist in various irregular signals which are conventionally expressed in words of "noise" and "fluctuation". Chaos has characteristic characters such as instability of path, unforecastability of future status, and fractalness of solution to geometrical structure. It is reported that it exists actually in many fields such as fluidic systems, chemical reaction systems, cranial nerves, lasers, beat of heart, biosystem, infectious diseases, and electronic circuits.

It is proposed recently that the learning basis for aiming at engineering application of Chaos and Fractal is called "chaotic engineering". (Mathematics and Science, No. 348, p. 5, June, 1992).

Furthermore, B. B. Mandelbrot and J. W. V. Ness define the fractional brownian motion (fBm) as extension of the brownian motion. (B. B. Mandelbrot & J. W. V. Ness, "Fractional Brownian Motions, fractional noises and applications", SIAM Review 10, 4 (1968), 422–437). In other words, V(t) which is fBm is a function of one variable and is defined to prescribe the following scaling rule.

$$\Delta V = V(t_2) - V(t_1) \propto \Delta t^H \quad (1)$$

where $$\Delta t = t_2 - t_1$$

H: Scaling factor

H can be obtained as an inclination of a graph of log $\Delta t$ vs log $\Delta V$ or from a spectral index $\beta$ which means a gradient when the spectral density (power spectrum) S(f) is in inverse proportion to the frequency.

Assuming that V(t) is statistically a function of self-affine fractional Brownian motion, the following relationship is held between H, fractal dimension D, and spectral index $\beta$.

$$D = 2 - H,$$

or $$D = 1 + (3 - \beta)/2 \quad (2)$$

where $\beta$ = spectral index.

The spectral density S(f) is expressed as follows:

$$S(f) \propto 1/f^{\beta} \quad (2a)$$

As algorithms for creating such Fractal, the independent random cuts method, spectral synthesis method, midpoint displacement method, successive random addition method, and Weirstrass-Mandelbrot fractional function method are well known.

Furthermore, the following list has some similarity to the aforementioned Fractal according to the ideas thereof.

(1) Music or, particularly, technique a musical Figure (2) Horoscopy (3) Samasara (metempsychosis) of Buddhism (4) Mandala of Buddhism

SUMMARY OF THE INVENTION

An object of the invention is to provide a control method or unit which can be realized by incorporating the aforementioned fractal, chaos, or fractional Brownian motion into amenity products or actual systems within the practical range particularly as motion of rotating machines among them. (To realize chaos or fractional Brownian motion in the strict sense is not always the object of the present invention.)

Another object of the present invention on a washing machine is to provide a control unit for a washing machine which obtains good washing results and simultaneously minimizes twisting and tangling of clothes and damaging of clothes mentioned above.

In other words, another object of the present invention is to provide a control method or unit for amenity products and rotating machines under a basic concept that to solve the aforementioned problems of the prior art as far as possible, the washing and drying performance is improved, the washing status of an electric washing machine is brought closer to the hand washing status (washing using a washboard in Japan), the state in a washing tub is brought to closer to the turbulent state on the basis of the same idea, and the water flow is brought closer to "fractal water flow" or "chaos water flow" because hand washing and turbulent flow may be said as "fractal water flow" and "chaos water flow" (words coined by this writer, hereinafter the operation control method of the present invention shown in FIG. 8 is referred to as a "fractal operation", "natural operation", or "comfortable operation" and the water flow which is generated in the washing tub by the above method is referred to as "fractal water flow" or "chaos water flow") or a washing machine or clothes dryer using the above control unit.

To accomplish the above objects, according to the present invention, the following processing is performed.

(1) In a natural phenomenon or comfortable stimulation pattern, there is no linear spectrum fixed cycle. Therefore, the motion fluctuation depends on the frequency and is controlled with regularity.

(2) The power spectrum of the motion in (1) is in the state that the spectral index $\beta$ which is a gradient when the power spectrum is in inverse proportion to the frequency at least within a particular frequency range can be defined, that is, in the state that the power spectrum has a fractional time series (self-similarity) and the fractal dimension or correlation dimension which will be described later is determined.

(3) The aforementioned regularity is to control so as to decrease at least one of the control parameters for operating, for example, amenity products and rotating machines slowly at a reduction rate down to the controllable limit.

(4) The above operation is iterated recursively as a fundamental rule. Furthermore, this recursive operation is iterated.

(5) At least one of each control parameter for operating amenity products and rotating machines, the reduction rate thereof, the number of dimensions (times) of the above recursive iteration, and the number of times of iteration of recursive operation is given by a random amount which varies within a predetermined range.

(6) The above iteration of recursive operation is performed self-similarly to an operation toward a high dimension at an individual recursive reduction rate.

(7) The number of times of self-similar iteration is given by a random amount which varies within a predetermined range again.

Furthermore, concretely, (8) The powered rotation angle or powered rotation period of a rotating machine such as a rotary wing, impeller, agitator, or drum and the coasting rotation period or coasting rotation angle for stopping current supply to the motor are controlled and the initial large rotation angle or time is reduced slowly at a predetermined reduction rate (this is assumed as a fundamental rule mentioned above) and this operation is performed recursively.

(9) The recursive operation in (8) is iterated.

(10) To perform the above operation, a basic algorithm that the powered rotation angle or period in the forward direction is provided, and the coasting rotation period or angle is provided, and then the powered rotation angle or period in the reverse direction is provided is prepared.

(11) Furthermore, at least one of the above powered rotation angle or period, and the coasting rotation period or angle, and the reduction rate of the powered rotation angle or period, and the reduction rate of the coasting rotation period or angle, and the number of times (dimension) of recursive iteration is provided as a random amount which varies within a predetermined range.

(12) The above recursive operation is furthermore iterated self-similarly.

The control method for the above operation is as follows:

(1) The motion fluctuation and rotation speed variation of amenity products and rotating machines have a fractional time series from a high frequency which can be controlled by a recursive operation to a low frequency by an iteration operation.

(2) Although there is a tendency that a particular frequency is enhanced, the power spectrum of fluctuation and variation in (1) is not a single intrinsic spectrum and continuous in the frequency range requiring a power spectrum.

(3) The inclination of the power spectrum is controlled so that the spectral index $\beta$ which is a gradient when the power spectrum is in inverse proportion to the frequency f can be defined with a high correlation coefficient.

(4) The aspect becomes similar to a phenomenon in the natural world.

(5) The control is added with nature and a hand finishing sense and contributes to improvement in performance.

Therefore, when this control unit for amenity products and rotating machines is applied, for example, to a washing machine, the washing operation of an electric washing machine can be brought closer to the hand washing status. In other words, the state in the washing tub can be brought to close to the state which is expressed by "fractal water flow", "chaos water flow", or "natural water flow" by a comparatively simple means. By doing this, the washing performance of an electric washing machine is improved and the uneven washing is reduced simultaneously. Furthermore, the drying capacity of a drier improves and damaging of clothes is reduced.

BRIEF DESCRIPTION OF THE DRAWINGS

FIG. 10(*a*) shows displacement vs time characteristics and FIG. 10(*b*) shows a power spectrum (ratio of square amplitude).

FIG. 11(*a*) shows displacement vs time characteristics and FIG. 11(*b*) shows a power spectrum (ratio of square amplitude).

FIG. 29 is a block diagram of a control unit for an electric fan to which the method of the present invention is applied to.

FIG. 30 is a block diagram of a control unit for an electric heater to which the method of the present invention is applied to.

FIG. 31 is a block diagram of another control unit in consideration of temperature control for the example shown in FIG. 30.

DETAILED DESCRIPTION OF THE PREFERRED EMBODIMENTS

Figure 1:
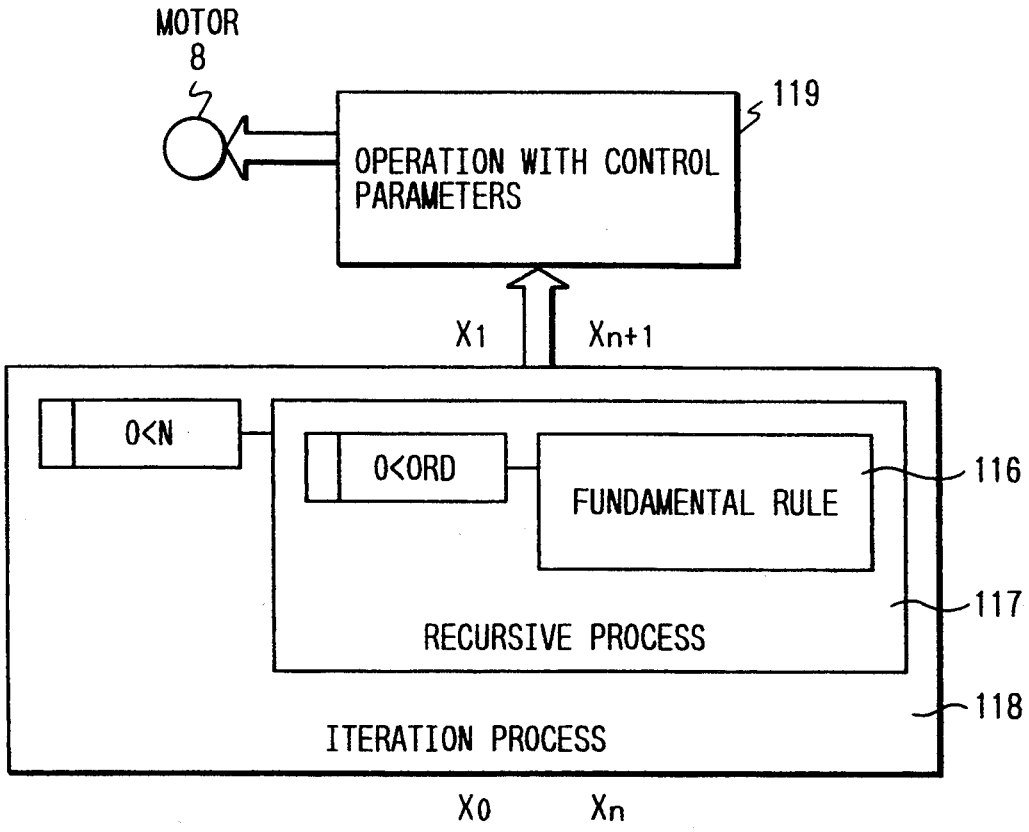
FIG. 1 is a basic flow chart of the present invention.

An example which the method of the present invention is applied to will be described hereunder as a typical example of amenity products and rotating machines. Firstly, the clothes washing operation will be studied so as to make problems clear and then the embodiments of the present invention will be explained.

Washing uses the synergistic effect of a detergent and mechanical energy given to fibers. A detergent has a function for reducing force acting between fibers and stain grains and a function for preventing stains removed from fibers from adhering to fibers again.

Furthermore, mechanical energy is necessary to separate stains from fibers. In the case of an electric washing machine, the above mechanical energy is given by rotary motion of the rotary wing, reciprocating rotary motion of the agitator, or reciprocating rotary motion of the drum.

However, the following problems are caused.

(1) Twisting and tangling of clothes, damaging of clothes, and uneven washing are caused.

(2) The mechanical energy cannot be transferred to large clothes easily.

(3) Wool clothes shrink.

For the problem in (2), according to the aforementioned prior art, controlling the powered rotation angle of the rotary wing or agitator is effective.

The problem in (1), particularly, uneven washing is considered to be caused by unstationary water flow in the washing tub.

To increase the washing capacity in the stationary water flow state, it is necessary to make the flow stronger such as increasing the flow rate. By doing this, damaging of clothes and uneven washing are easily generated. Although twisting and tangling of clothes are complicated phenomena, it may be considered that the cause is the aforementioned stationary water flow.

To prevent the above stationary water flow so as to give mechanical energy uniformly to clothes, it is necessary to bring the water flow in the washing tub close to turbulence or the hand washing status.

Turbulence is related strictly to Fractal and it is described in detail in Tatsumi and Kida, "Turbulence and Fractal", Mathematics and Science, No 221, pp. 21 to 27, 1981. Turbulence is extremely complicated fluid motion wherein various large and small types of whirlpool motion are mixed irregularly and relations between turbulence and fractal are broadly divided into two types as shown below.

(1) Shape of turbulence: The shape of the turbulence boundary surface corresponds to the fractal drawing.

(2) Structure of turbulence: Turbulence is an energy cascade process that large whirlpool motion is generated by external force first and then the energy is transferred gradually to small types of whirlpool motion and lost by the fluid viscosity finally. In this process, small-scale types of whirlpool motion are distributed spatially uniformly which causes intermittence.

Furthermore, the above document describes that small-scale types of motion of turbulence clearly depend on large-scale types of motion.

The hand washing operation (an operation that clothes were washed by both hands using a washtub and washboard in Japan when there were no electric washing machines) can be divided as follows:

(1) A piece of washing is held by both hands and moved, for example, down greatly and then up inversely.

(2) The above operation is iterated several times by decreasing the movement amplitude gradually.

(3) The piece of washing is moved greatly in one direction, for example, up once again and the operation in (2) is performed.

(4) The above operations (1) to (3) are iterated by changing the movement amplitude each time.

It is considered that the above hand washing operation has the aforementioned turbulence or fractal structure.

Figure 10A:
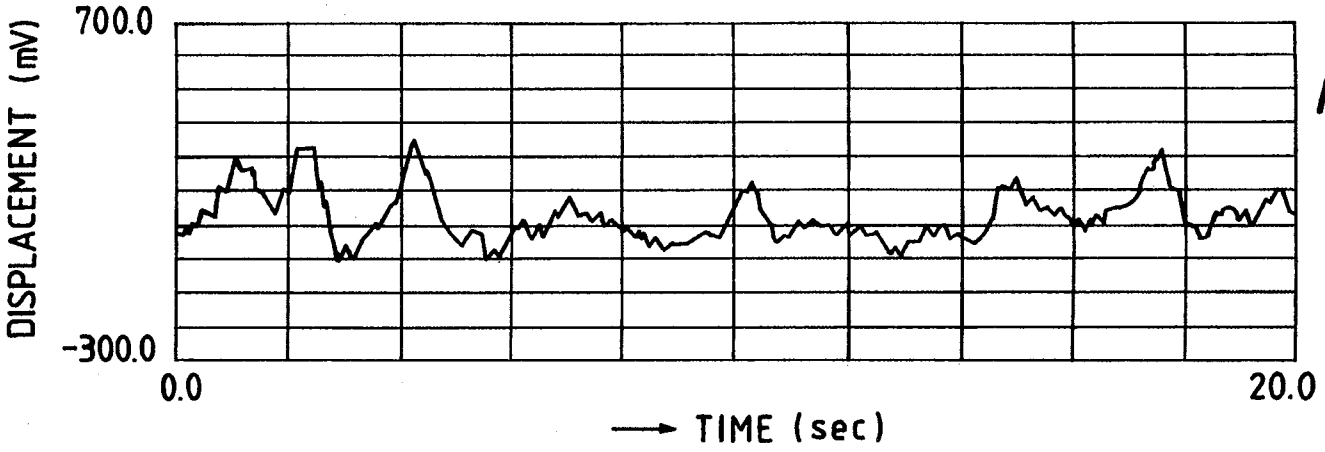
FIGS. 10(*a*) and 10(*b*) are graphs showing analytical results of a typical hand washing operation (washing of socks).
Figure 10B:
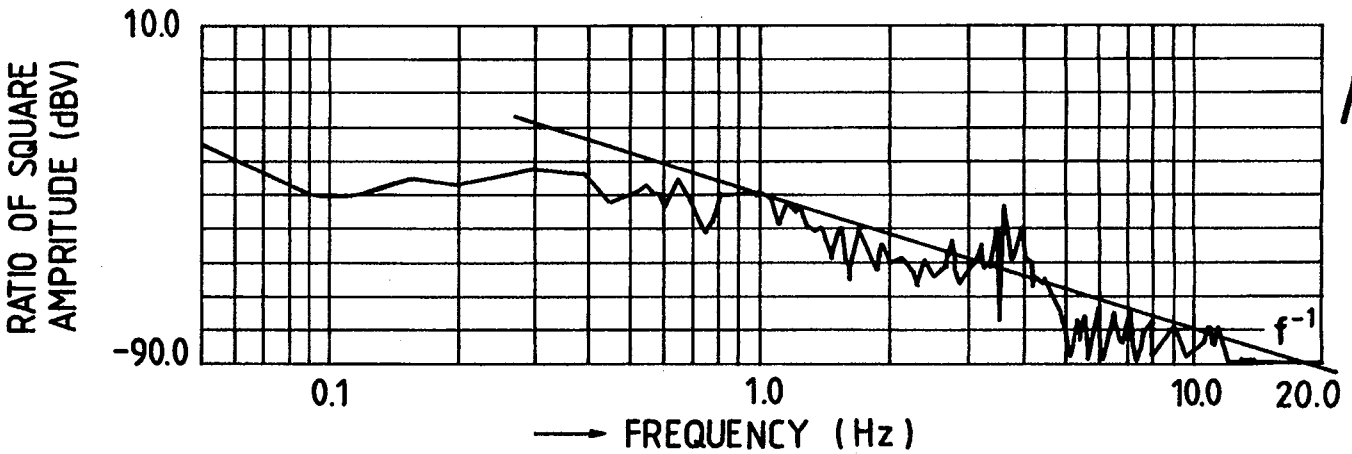
Figure 11A:
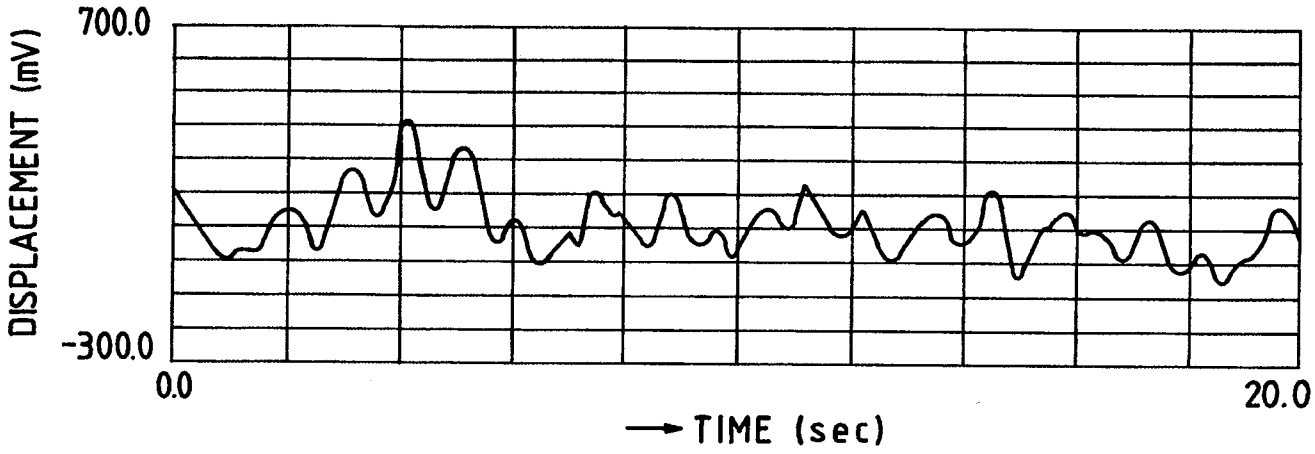
FIGS. 11(*a*) and 11(*b*) are graphs showing analytical results of a typical hand washing operation (washing of a white shirt).
Figure 11B:
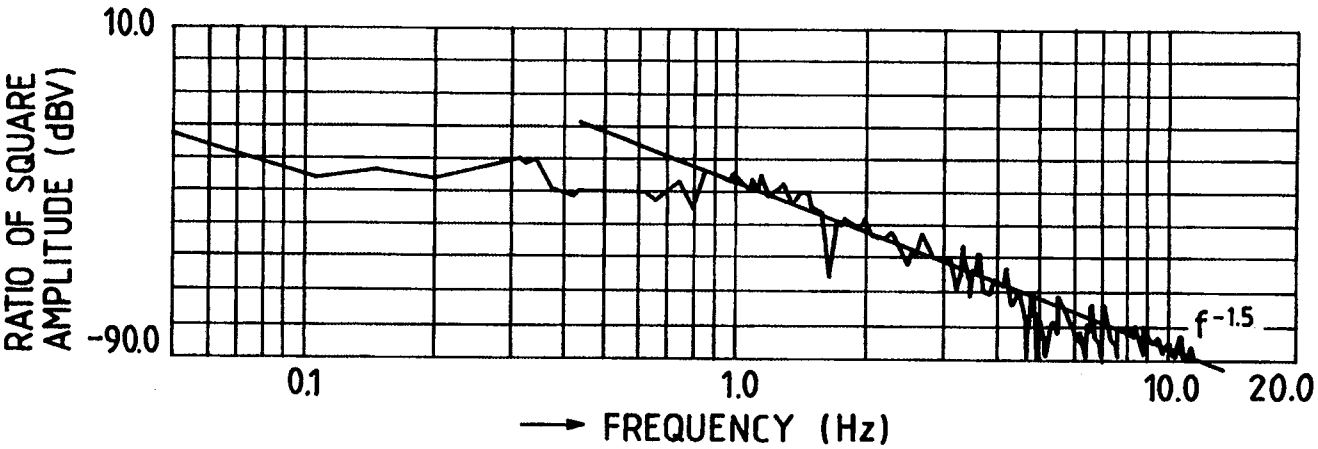

To actually analyze the "hand washing" operation, the hand motion of the following washing patterns is measured and the results are shown in FIGS. 10(*a*) and 10(*b*) and FIGS. 11(*a*) and 11(*b*).

(i) Washing of socks (FIGS. 10(*a*) and 10(*b*)).

(ii) Entire washing of a white shirt (FIGS. 11(*a*) and 11(*b*)).

FIGS. 10(*a*) and 11(*a*) show hand displacement vs time and FIGS. 10(*b*) and 11(*b*) show the spectra with a ratio of square amplitude. Therefore, the power spectrum S(f) is the value shown in FIG. 10(*b*) or 11(*b*) which is converted to a speed plus a gradient to which 20 dB is added for 10 times of the frequency.

FIGS. 10(*b*) and 11(*b*) show great characteristics that the power spectrum S(f) has continuity and fractional time series (the fractal dimension D, which is described later, can be defined with a high correlative coefficient within a particular frequency range) or the gradient $\beta$ when the power spectrum S(f) is in inverse proportion to the frequency, that is, the spectral index $\beta$ can be defined with a high correlative coefficient (at least 0.9) by processing a plurality of representative values within a particular frequency range using the least square method.

Furthermore, FIG. 10(*b*) has a characteristic that the spectral index $\beta$ shown by a straight line in the drawing is close to 1. There is a tendency that a particular frequency is enhanced.

Also in FIG. 11(*b*) wherein entire washing is performed, the power spectrum S(f) is continuous and the spectral index $\beta$ is close to 1.5 such as 1.52 within a frequency range from about 1 to 10 Hz and the correlative coefficient is extremely high such as 0.96. The motion is more dynamic than that shown in FIG. 10(*b*).

It can be inferred that there are fundamental rules as shown below.

(1) A piece of washing is held by both hands and moved, for example, down greatly and then up inversely.

(2) The above operation is iterated several times by decreasing the movement amplitude gradually.

(3) The piece of washing is moved greatly in one direction, for example, up once again and the operation in (2) is performed.

(4) The above operations (1) to (3) are iterated by changing the movement amplitude each time.

Therefore, according to the present invention, the following conditions are set in an electric washing machine by imitating the above hand washing operation.

(1) Small-scale types of motion are provided on the basis of large-scale types of motion and the recursiveness is a basic principle.

(2) The operation is made intermittent.

(3) The variation range of each control parameter is limited and a random value is used. (Pseudo random numbers may be used.)

Next, the present invention will be explained in detail with reference to the accompanying drawings.

FIG. 1 is a flow chart showing the concept of the present invention and an example of internal processing of microcomputer 1 is shown. Numeral 116 indicates a fundamental rule for driving a motor 8, which is set, for example, as shown below.

(1) The motor is driven comparatively slowly first and stopped longer.

(2) Next, the motor is driven with the rotation period and stop period multiplied by a reduction rate so that the rotation period and stop period are made smaller than at least those shown in (1).

Next, although the dimension is properly limited by a recursive process 117, the above operation is iterated recursively. In other words, when the initial rotation period and stop period are set to X0, the next value X1 is given as a function of X0. According to the present invention, X1 is X0 multiplied by a reduction rate.

Next, the above operation is iterated by an iteration process 118 self-similarly as far as possible. When the rotation period, stop period, reduction rate, and dimension (the number of times of iteration by the recursive process 117) are set as random amounts which vary within fixed ranges in this case, fine rotational changes can be obtained. In other words, the power spectrum of rotary motion of the motor 8 can be made continuous at least within a particular frequency range dependently of the frequency, that is, the amplitude can be decreased as the frequency increases. Furthermore, since the fundamental rule is used, the power spectrum can be made statistically inversely proportional to the power index of the frequency (spectral index $\beta$) by the averaging processing. This phenomenon has a fractional time series (self-similarity) which is often found in a natural phenomenon and the rotary motion shows chaotic behavior.

Figure 2:
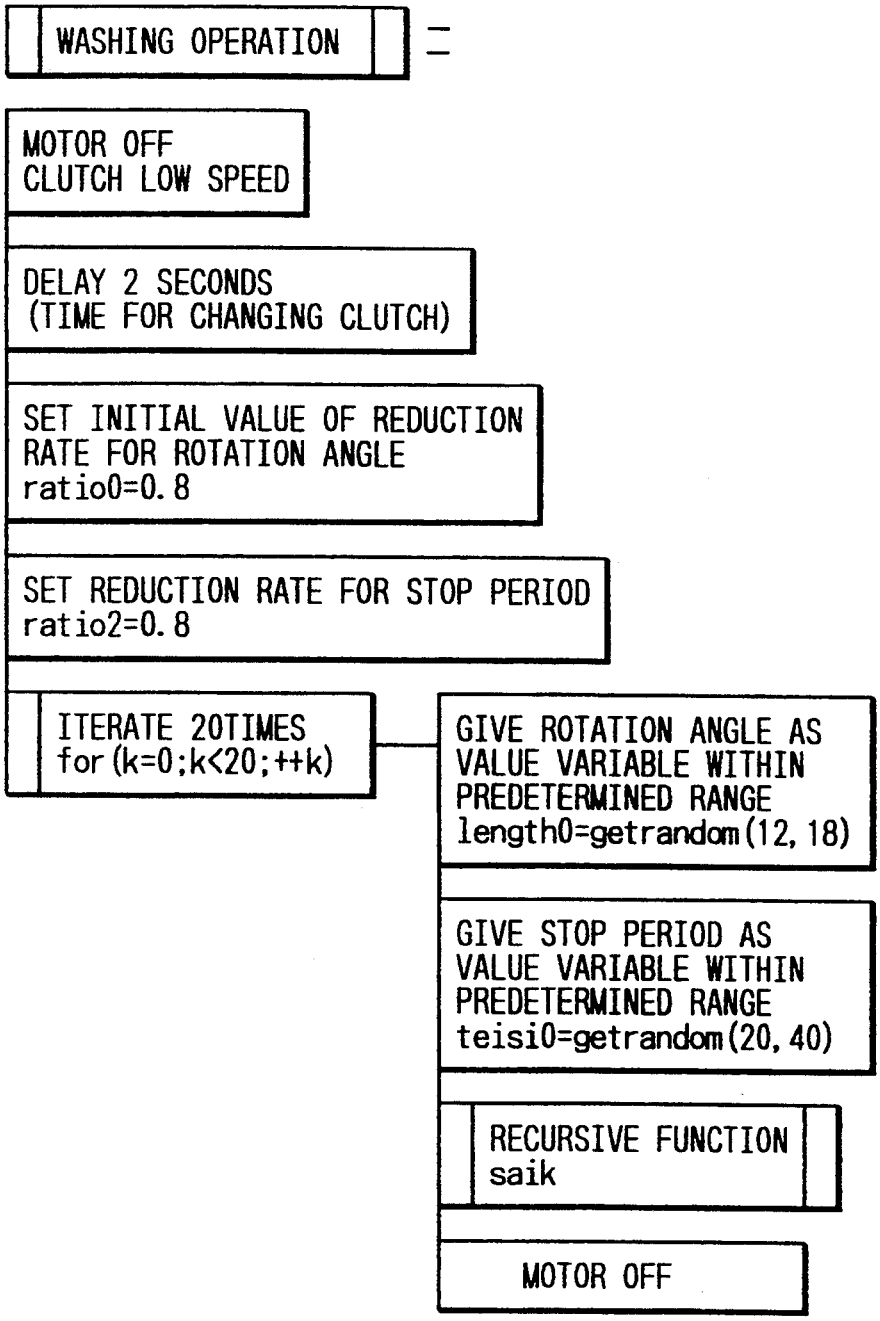
FIG. 2 is a rough PAD diagram (problem analysis diagram) showing the washing operation method of the present invention.
Figure 3:
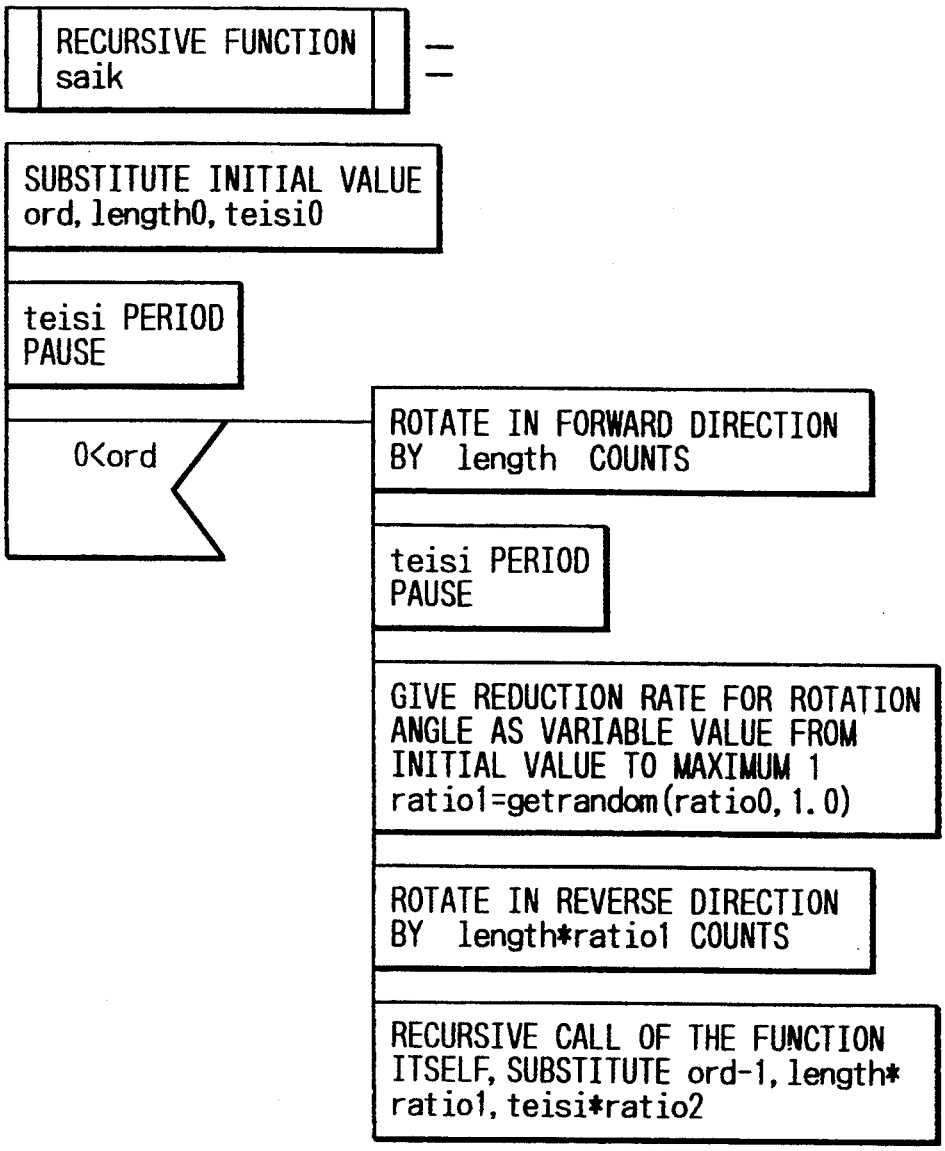
FIG. 3 is a rough PAD diagram of the recursive function used in FIG. 2.
Figure 4:
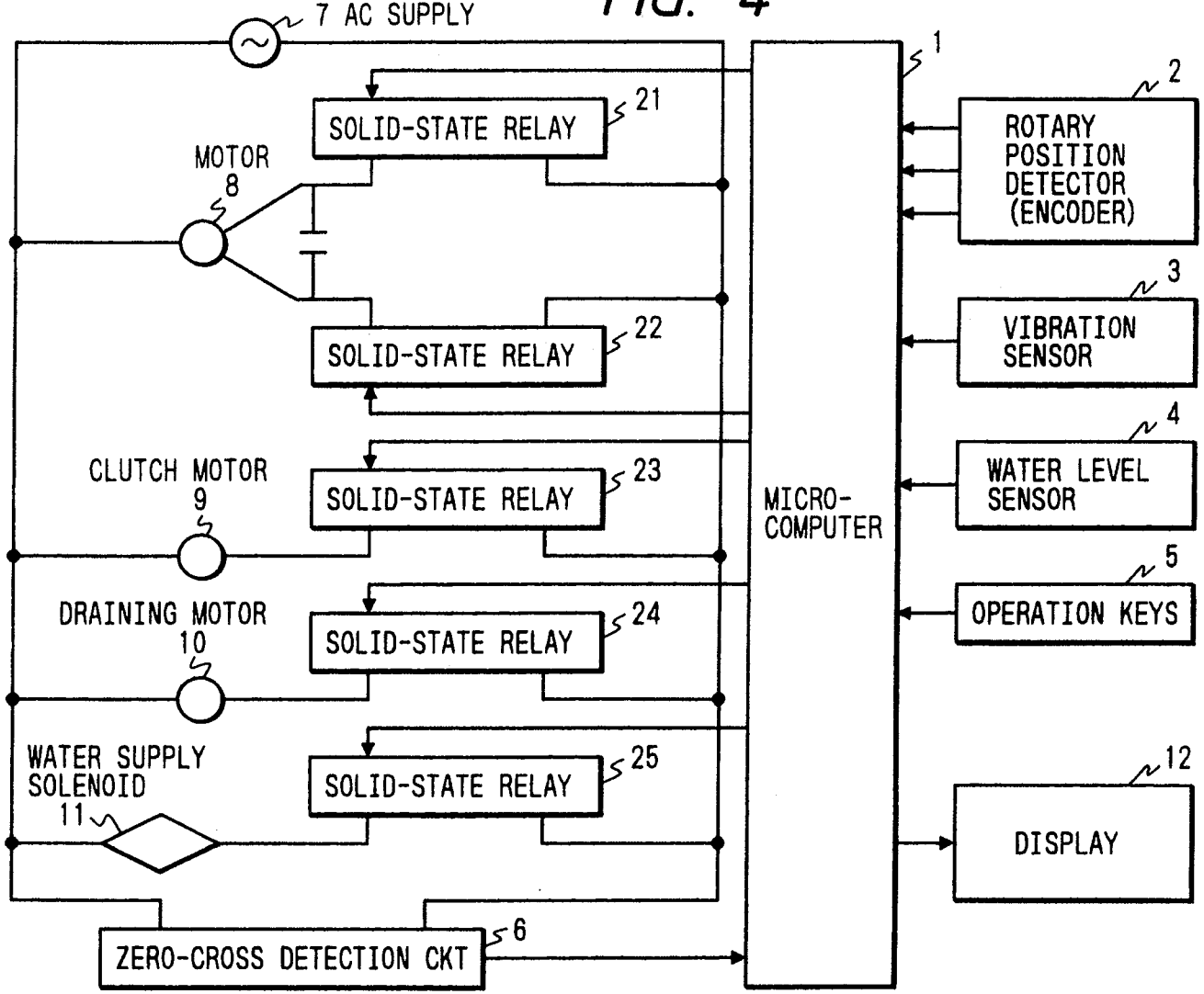
FIG. 4 is a block diagram of an example of a control unit when the method of the present invention is applied to control of a washing machine.

FIG. 2 is a PAD diagram (problem analysis diagram) of washing operation of a washing machine of the present invention. FIG. 3 is a PAD diagram of the function "saik", namely, recursive function, which is used in FIG. 2. FIG. 4 is a control system diagram of a fully-automatic washing machine of the present invention, and FIG. 5 is a sectional view of the above washing machine, and FIG. 6 is a rotational status diagram of the impeller.

Figure 5:
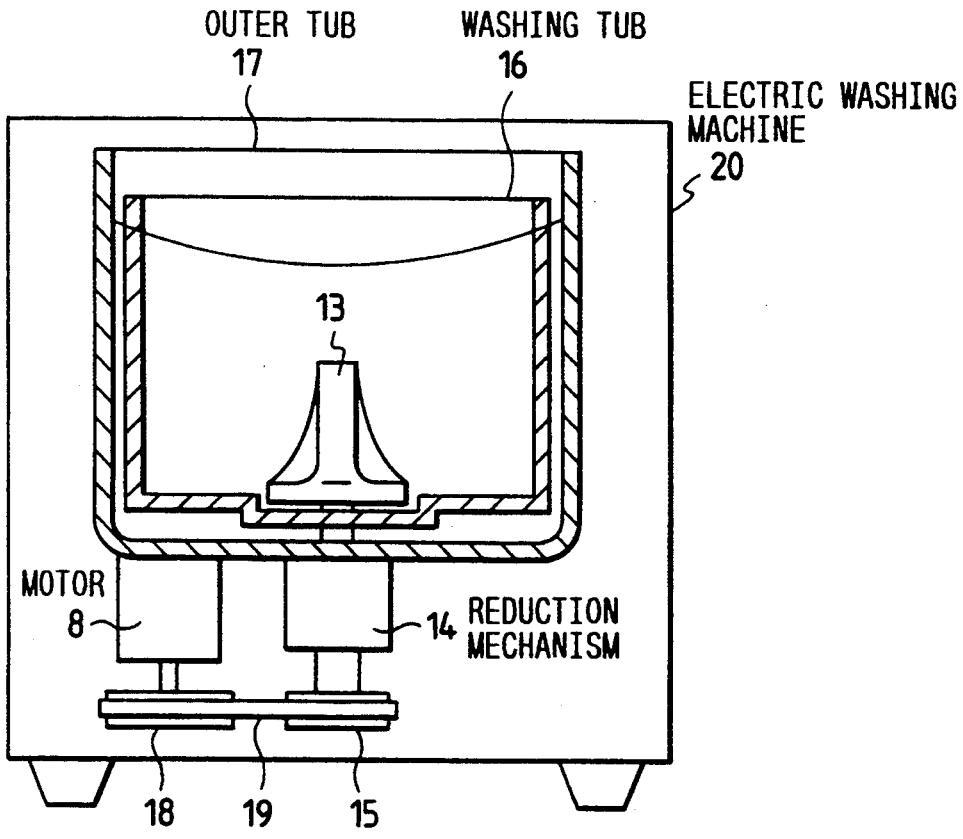
FIG. 5 is a sectional view of an example of the washing mechanism of a washing machine of the present invention.
Figure 6A:
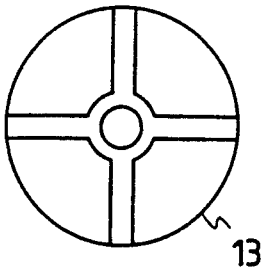
FIGS. 6(*a*), 6(*b*), 6(*c*), and 6(*d*) are plan views showing the rotation control status of an impeller of a washing machine of the present invention from the initial state to the first rotation.
Figure 6B:
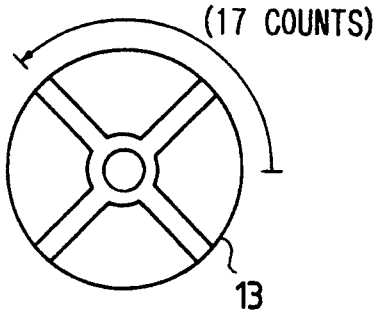
Figure 6C:
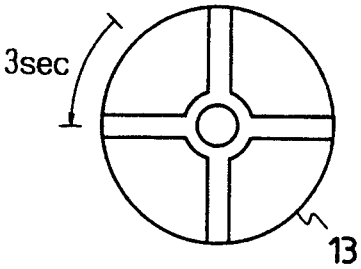
Figure 6D:
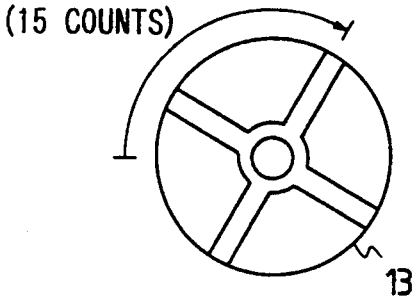
Figure 7A:
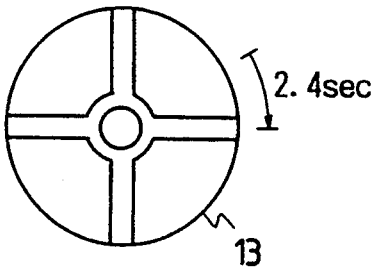
FIGS. 7(*a*), 7(*b*), 7(*c*), and 7(*d*) are plan views showing the rotation control status of the impeller of the washing machine of the present invention from the state in FIG. 6(*d*) to the second rotation.
Figure 7B:
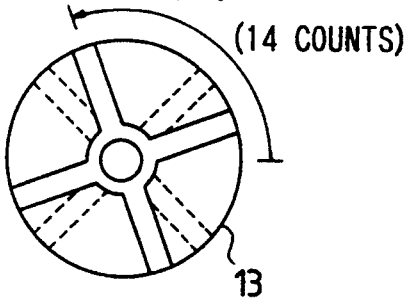
Figure 7C:
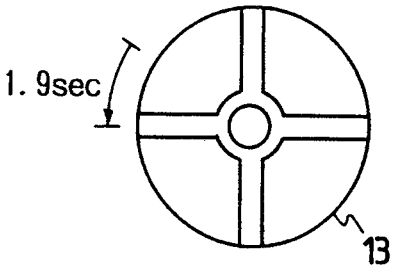
Figure 7D:
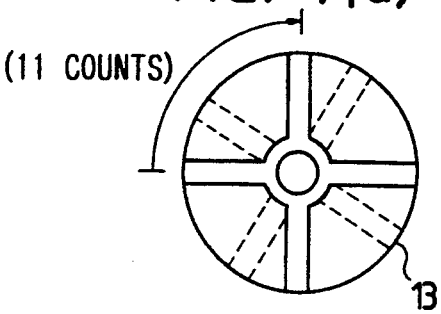

In FIGS. 4 and 5, numeral 1 indicates a microcomputer which is a central part of the control unit, and a rotary position detector 2 which is mounted to a pulley 15 of a reduction mechanism 14 so as to detect the rotational angle of a impeller 13, a vibration sensor 3, a water level sensor 4, a zero-cross detection circuit 6 for detecting the timing that the voltage of an AC power source 7 is reduced to 0, and operation keys 5 are mounted. The motor 8, a clutch motor 9 for switching the reduction mechanism 14 to Low Speed for washing or to High Speed for dehydration, a draining motor 10 for draining, and a water supply solenoid 11 for opening or closing a water supply valve are controlled by the microcomputer 1 via solid-state relays 21 to 25.

The rotation of the motor 8 is transferred to the pulley 15 of the reduction mechanism 14 from a pulley 18 integrated with the rotary shaft of the motor 8 via a belt 19, converted to a predetermined rotational speed by the reduction mechanism 14, and transferred to the impeller 13 finally.

Washing is put into a washing tub 16, and a predetermined amount of water is supplied to an outer tub 17, and the impeller 13 is rotated so as to perform washing.

The rotary position detector 2 is structured so as to irradiate, for example, light of a light emitting element of a reflective type photo interrupter to the pattern surface of the pulley 15 which has a black part with a low light reflectance and a white part with a high light reflectance, to receive the reflected light by a light sensitive element, and to generate a 2-phase signal with a phase difference of 90°.

The microcomputer 1 detects the rotary direction and position of the impeller 13 by the above 2-phase signal. For example, when the impeller 13 rotates clockwise, the microcomputer counts up the above 2-phase signal and when the impeller 13 rotates counterclockwise, the microcomputer counts down the above 2-phase signal so as to detect the rotary position of the impeller 13. When the equipment is structured so that the rotational angle of the impeller 13 is 10 to 50 per count, it is most suitable from a view point of controllability, washing capacity, and damaging of clothes.

Next, the operation control method of the present invention will be explained with reference to FIGS. 2 and 3 showing the PAD diagrams and FIG. 6.

(1) Before starting the motor, it is confirmed that the reduction mechanism 14 is set at Low Speed.

(2) It is necessary to wait for about 2 seconds as a switching time.

As parameters for controlling the rotation of the impeller 13, the powered rotation angle in the forward direction which is given first, the time for turning the motor OFF and executing coasting rotation or the time until stopping, and the powered rotation angle in the reverse direction are determined.

(*a*) Initial state (*b*) Powered rotation angle in the forward direction=length×(ratio 1)

where length: Count (Enumerated data by the rotary position detector 2)

ratio 1: Reduction rate of the rotational angle (count)

(c) Stop period (coasting rotation period)=teisi×(ratio 2)

where teisi: Stop period ratio 2: Reduction rate of the stop period (d) Powered rotation angle in the reverse direction=length×ratio 1

(3) The initial value (ratio 0) of the reduction rate of the rotational angle is determined as 0.8.

(4) The reduction rate (ratio 2) of the stop period is determined as 0.8.

(5) The initial value (length 0) of the count indicating the rotational angle is given as a value which varies within a predetermined range (count 12 to 18:10° per count) every time.

(6) The initial value (teisi 0) of the variable (teisi) indicating the stop period is given as a value which varies within a predetermined range (20 to 40 (2 to 4 seconds): 0.1 seconds per count) every time. For example, the initial value is set to 30 and the stop period is set to 3 seconds.

(7) The values of length 0 and teisi 0 and the recursive call dimension (dimension of iteration) "ord" in Items (5) and (6) are substituted for the recursive function (saik) as initial values. The dimension "ord" is set to a number which will not be reduced to less than 1 which is the smallest count when the rotational angle is reduced, for example, 10. 0 indicates the end of the recursive process.

In FIG. 6(*a*), the motor 8 stops driving for the teisi period (3 seconds) first.

(8) The impeller 13 is rotated in the forward direction by the length count.

The impeller 13 is forced to rotate in the forward direction until the enumerated data obtained by the rotary position detector 2 matches a random value (for example, 17) which is set in Item (5) from the initial state shown in FIG. 6(*a*) as shown in FIG. 6(*b*). The random value may be a pseudo random number which can be easily created by the microcomputer 1 by the linear congruent method or by storing it.

(9) The motor 8 stops driving for the teisi period (3 seconds).

As shown in FIG. 6(*c*), the impeller 13 continues the coasting rotation during that period (for 3 seconds first).

(10) The reduction rate (ratio 1) of the rotational angle is given as a value which changes between the initial value 0.8 which is determined in Item (3) and the maximum value 1 every time. For example, ratio 1 is set to 0.9.

(11) The impeller 13 is rotated in the reverse direction until the count reaches length×ratio 1.

The impeller 13 is forced to rotate in the reverse direction of the direction shown in FIG. 6(*b*) until the rotary position detector 2 counts $17\times0.9=15$ for the value 17 which is obtained in Item (8) from the state shown in FIG. 6(*c*) as shown in FIG. 6(*d*).

(12) The following are substituted for the recursive function (saik) as dimension values and the function itself is called recursively (recursive call).

ord=ord−1 length=length×ratio 1 teisi=teisi×ratio 2

In other words, the operation control is applied as shown in FIGS. 7(*a*) to 7(*d*) next.

(a) The motor 8 stops driving for $3\times0.8=2.4$ seconds and the impeller 13 performs coasting rotation during that period as shown in FIG. 7(*a*).

(b) The impeller 13 is forced to rotate until the enumerated data obtained by the rotary position detector 2 reaches length×ratio $1=15\times0.9=14$ in the forward direction. (FIG. 7(*b*)).

(c) The motor 8 stops driving for $2.4\times0.8=1.9$ seconds and the impeller 13 performs coasting rotation during that period as shown in FIG. 7(*c*).

The reduction rate (ratio 1) of the rotational angle is given as a value, once again, which changes between the initial value 0.8 and the maximum value 1 every time. For example, ratio 1 is set to 0.8.

(d) The impeller 13 is rotated in the reverse direction until the count reaches length×ratio 1. The impeller 13 is forced to rotate in the reverse direction of the direction shown in FIG. 7(*b*) until the rotary position detector 2 counts $14\times0.8=11$ for the value 14 which is obtained in Item (f) from the state shown in FIG. 7(*c*) as shown in FIG. 7(*d*).

Figure 8A:
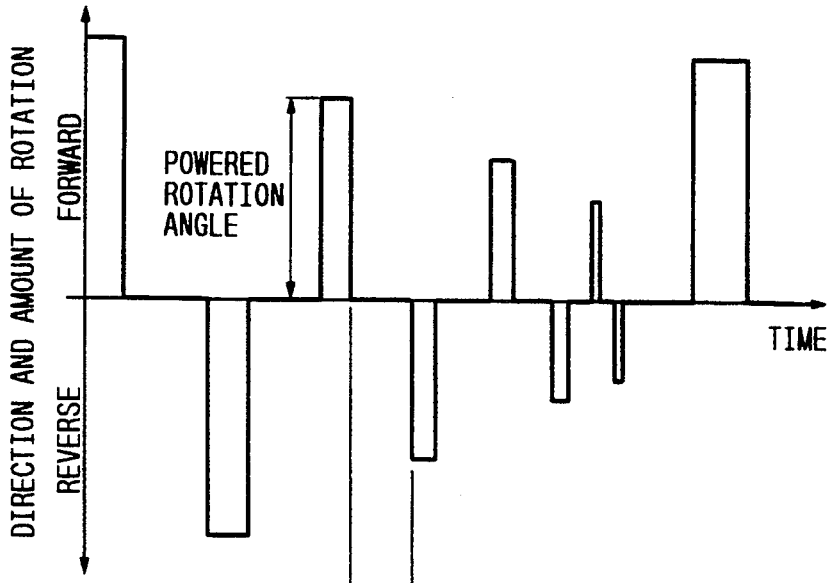
FIGS. 8(*a*) and 8(*b*) are timing charts showing the rotation direction, amount, and rotation position of an impeller of a washing machine of the present invention.
Figure 8B:
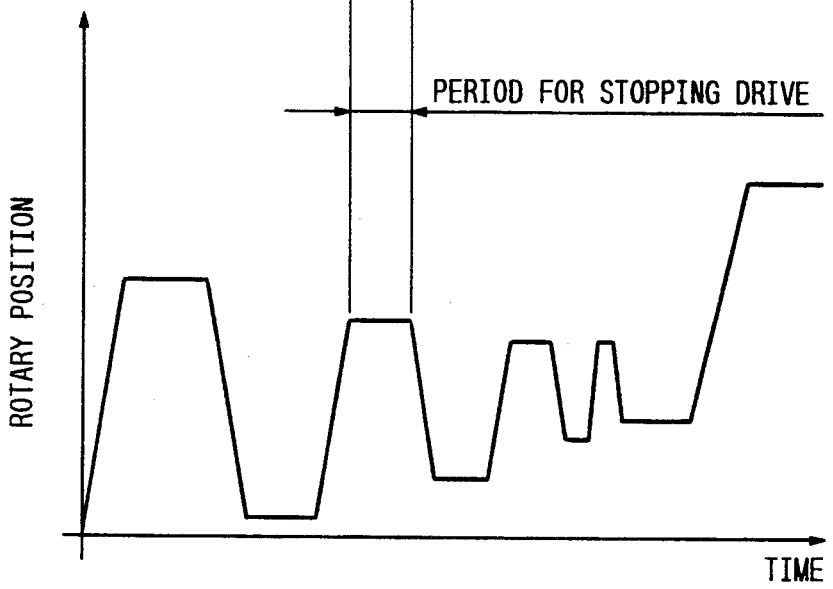

(13) Next, the initial comparatively large motion is changed slowly to small motion with a higher dimension until the dimension ord reaches 0 and the operation in Item (12) is iterated intermittently. FIGS. 8(*a*) and 8(*b*) are schematic diagrams showing the above rotary direction and amount and the relation between rotary position and time.

(14) When the above recursive operation ends, the initial value of a comparatively large rotary angle is given once again and the control in Item (5) is iterated by a predetermined count (for example, 20 times).

In the above description, the motor drives always in the forward direction in the early stage. However, the motor may drive in the forward direction for the first 6 times and in the reverse direction for the next 6 times alternately. However, the rotary position moves in the forward direction first and then moves slowly in the reverse direction. For example, when a basic operation that the count decreases gradually from 5 times to 3 or 2 times and the direction is changed is iterated, fluctuation at a lower frequency can be generated and satisfactory results can be produced. Needless to say, the number of times of iteration which is given gradually may be given as a random amount and the basic operation may be iterated furthermore.

In the basic algorithm that the above powered rotation angle in the forward direction is given first and the coasting rotation period and then powered rotation angle in the reverse direction are given, even if the rotary position detector 2 is omitted and the powered rotation angle is set as a powered rotation period, uneven washing can be reduced and the washing rate can be increased, though they are easily affected by the amount of clothes.

Furthermore, the coasting rotation angle may be controlled in place of the coasting rotation period so as to produce the same effect.

Furthermore, in the above description, pseudo random numbers are used as control parameters. However, a rule of occurrence expressed by a character string may be used. For example, the rule of occurrence is expressed as follows:

Rule of occurrence

| | |
|---|---|
| 0: | (1) Powered rotation by the count of length in the forward direction |
| | (2) Stopping of motor drive for the teisi period |
| | (3) Powered rotation by the count of length × ratio 1 in the reverse direction |
| | (4) Stopping of motor drive for the teisi period |
| 1: | (1) Powered rotation by the count of length × ratio 3 in the forward direction |
| | (2) Stopping of motor drive for the teisi period |
| | (3) Powered rotation by the count of (length × ratio 1) × ratio 3 in the forward direction |
| | (4) Stopping of motor drive for the teisi period |
| 2: | (1) Powered rotation by the count of length × ratio 3 in the reverse direction |
| | (2) Stopping of motor drive for the teisi period |
| | (3) Powered rotation by the count of (length × ratio 1) × ratio 3 in the reverse direction |
| | (4) Stopping of motor drive for the teisi period |

ratio 1, ratio 3: Constant of the reduction rate (a numerical value of 1 at most) of the rotary angle and the rule of occurrence is described by a character string step by step as shown below.

Step 0: 0

Step 1: 01020

Step 2: 00[01020]00[01020][01020]

When the step is generalized:

$$T(n+1)=02n[T(n)]02n[T(n)]T(n)$$

where T(n) indicates the rules of occurrence up to Step n and 02n indicates arranged 2n 0s.

The rule of occurrence T(n+1) having the reduction rate is iterated by a predetermined count as a basic algorithm.

According to the aforementioned control method for amenity products or rotating machines, motion fluctuation or rotational speed variations of those amenity products and rotating machines have a fractional time series with self similar elements and uncertainty added in the same way as with a phenomenon in the natural world.

Figure 12A:
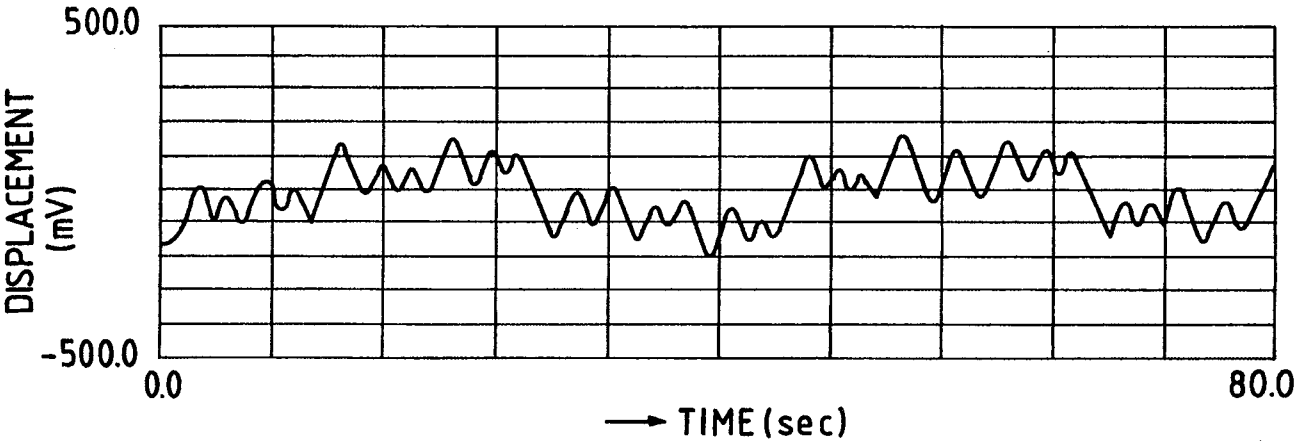
FIGS. 12(*a*)and 12(*b*) are graphs showing examples of changes with time of the rotational displacement and the power spectrum of a rotary wing when the number of dimensions (times) of iteration of the fundamental rule of operation of the present invention is set to 1 to 3.
Figure 12B:
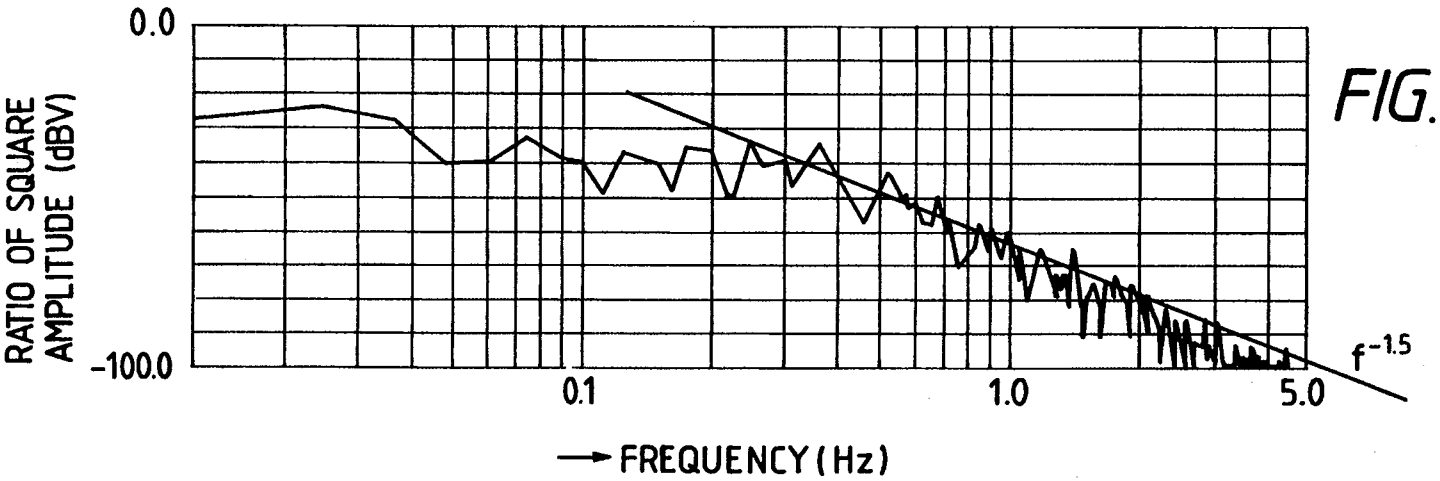
Figure 13A:
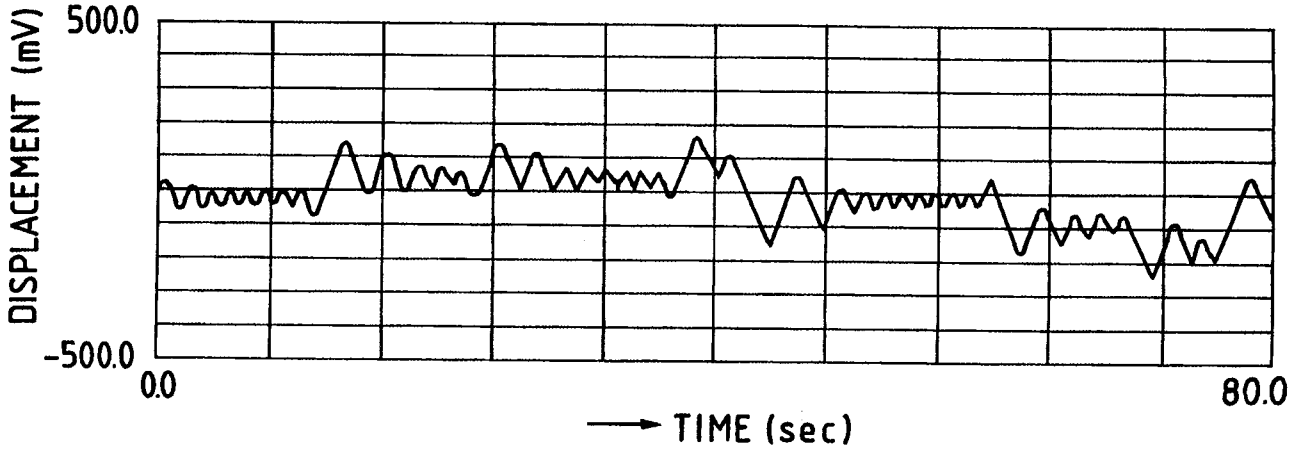
FIGS. 13(*a*) and 13(*b*) are graphs showing examples of changes with time of the rotational displacement and the power spectrum of a rotary wing when the number of dimensions (times) of iteration of the fundamental rule of operation of the present invention is set to 2 to 10.
Figure 13B:
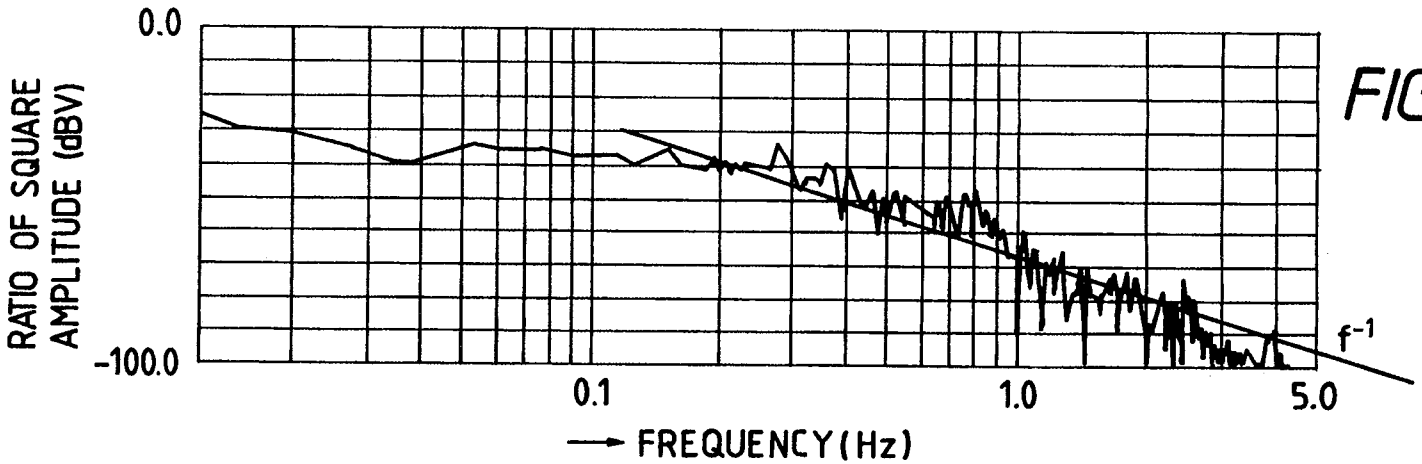

Examples that the motion of the impeller by the operation control unit of the washing machine described in the above embodiment is measured are shown in FIGS. 12(*a*) and 12(*b*) and FIGS. 13(*a*) and 13(*b*). FIGS. 12(*a*) and 13(*a*) are graphs of displacement (rotary angle) vs time and FIGS. 12(*b*) and 13(*b*) show the spectra with a ratio of square amplitude.

In both FIGS. 12(*b*) and 13(*b*), the power spectrum S(f) is continuous and has a fractional time series in the same way as with the hand washing operation and it is realized that the spectral index $\beta$ and fractal dimension D can be defined with a high correlative coefficient (at least 0.9) within a particular frequency range (about 0.3 to 5 Hz). FIGS. 12(*b*) and 13(*b*) show that although the variation range of the number of times of iteration (ord) of the fundamental rule is only set to 1 to 3 in FIG. 12(*b*) and 2 to 10 in FIG. 13(*b*), the spectral index B can be changed between 1.0 and 1.5 (actually between 1.2 and 1.8 or so). Furthermore, when it is applied to a control unit for an actual washing machine, it is confirmed that it is desirable from a view point of washing capacity and damaging of clothes to set the spectral index $\beta$ for washing large clothes to about 2.0 (a fractal dimension D of 1.5), the spectral index $\beta$ for standard washing to about 1.5 (a fractal dimension D of 1.75), and the spectral index $\beta$ for weak washing to about 1.2 (a fractal dimension D of 1.9).

Figure 14:
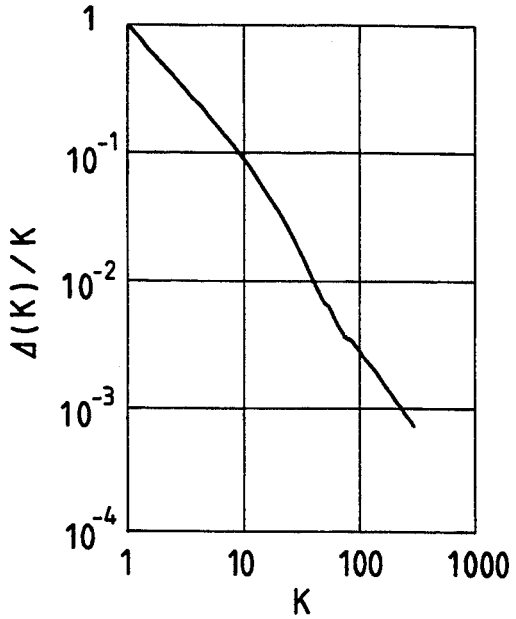
FIG. 14 is a broken line graph showing calculated values of the fractal dimension shown in FIGS. 12(*a*) and 12(*b*).
Figure 15A:
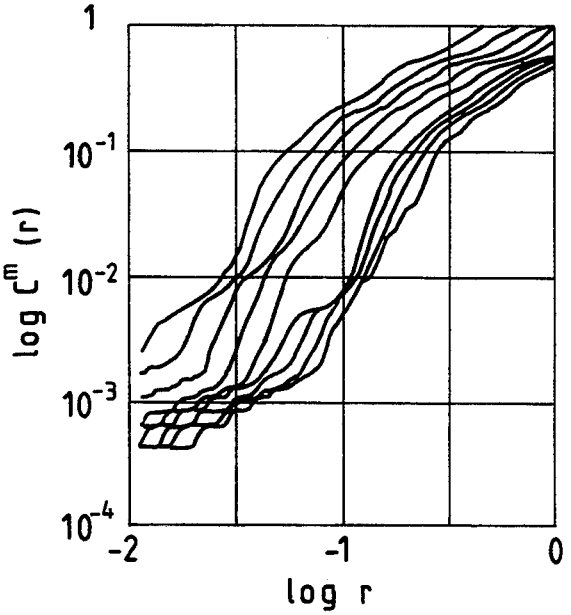
FIGS. 15(*a*) and 15(*b*) are broken line graphs showing calculated values of the correlation index and correlation dimension.
Figure 15B:
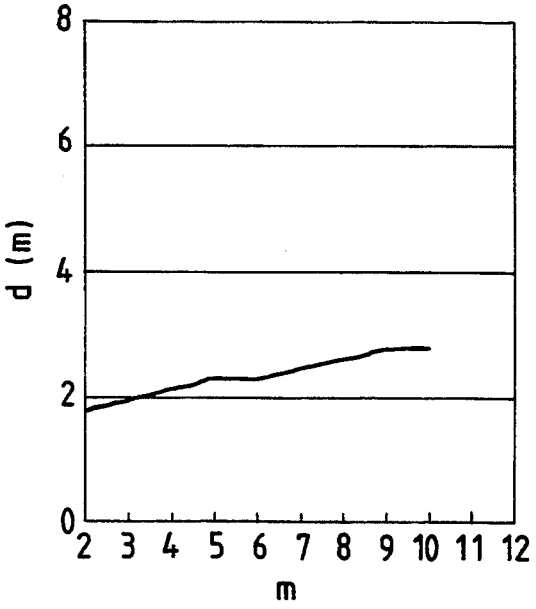

Furthermore, FIG. 14 is FIG. 12 where the vertical axis is changed to $\Delta(K)/K$ wherein $\Delta(k)$ indicates the length of polygonal line at a sampling interval of K (0.1 seconds for K=1) in the same way as with the fractal dimension of time series data which is indicated in I. Matsuba, "Chaos and Forecast", Mathematics Science, p. 66, No. 348, June 1992. When the motion is simple like a linear system, D=1. When the motion is confused, D=2. Therefore, in FIG. 14, when the sampling interval K is not more than 10, D is 1. When K is limited within an appropriate range (at least about 15), D is about 1.7. In FIG. 15, the correlative dimension is calculated as indicated in Ikeguchi and other 3 persons, "A Dimensional Analysis on Chaos Neural Networks", Journal of Institute of Electronics, Communications and Information Engineers of Japan, A Vol. J73-A, No. 3, pp. 486–494 (1990) or Kobayashi and other 3 persons, "Relation between Fractal Dimension of Fractuations in Fundamental Period and Naturality of Speech", Papers on Conference of Acoustics Society of Japan, 2-6-17, 3, pp. 361–362 (1992). The calculation method will be outlined hereunder. Time series data of a variable is taken as X(t) and an m-dimensional vector is structured by the following equation.

$$xt=\{X(t), X(t+\tau), X(t+2\tau), \ldots, X(t+(m-1)\tau)\} \quad (3)$$

where, $\tau$: magnitude of time delay

N vectors which are obtained in this way represent N points in the m-dimensional space. By counting the number of paired vectors having two points with a distance of at most r, a correlation integral C(r) is defined.

$$C(r) = 1/N^2 \sum_{i=1}^{N} \sum_{j=1}^{N} H(r - |xi - xj|) \quad (4)$$

where H indicates a Heaviside function.

When $t<0$, $H(t)=0$.

When $t>=0$, $H(t)=1$.

A distance of $|xi-xj|$ is an absolute distance.

$$|p - q| = \sum_{j=1}^{m} |pi - qj| \quad (5)$$

When the correlation integral which is calculated in this way is scaled as specified by the following formula in an appropriate area of r:

$$C^m(r) \propto r^{d(m)} \quad (6)$$

The scaling index d(m) is called a correlation index. When logarithm is performed for both sides of Formula 6:

$$\log C^m(r) \propto d(m) \log r \quad (7)$$

where d(m) is given by the inclination of the linear part within an appropriate range of r in a graph of logr vs $\log C^m(r)$.

The correlation dimension is defined as a value which when the correlation index d(m) is calculated by increasing m, d(m) is saturated and approximates to as m increases. In FIG. 15(*a*), the horizontal axis denotes logr and the vertical axis denotes logCm(r) when m=2 to 10. In FIG. 15(*b*), the horizontal axis denotes m in the scaling area shown in FIG. 15(*a*) and the vertical axis denotes a correlation index d(m) at that time. As a result, it is found that the correlation index when the dimension m of the restructure status space using the operation method of the present invention mentioned above is assumed as 2 is 1.8 and the correlation dimension is about 2.8.

Figure 16:
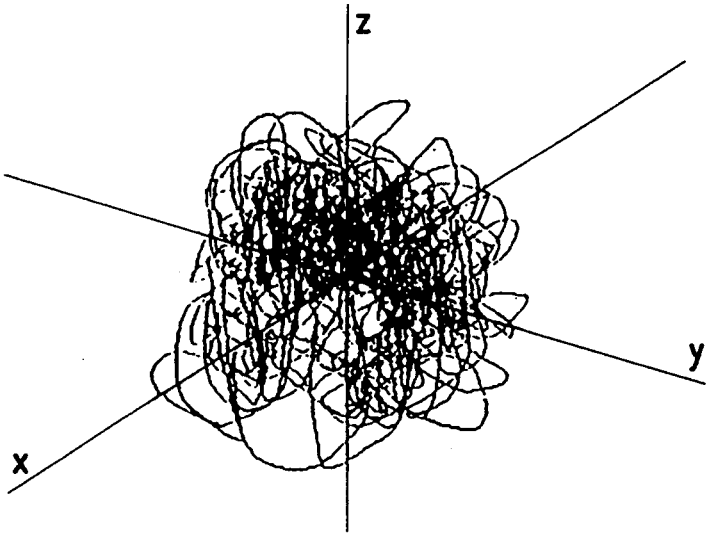
FIG. 16 is a three-dimensional broken line graph showing a three-dimensional phase space when the rotational displacement time series data of operation of the present invention is set to a time delay=40 seconds.
Figure 17:
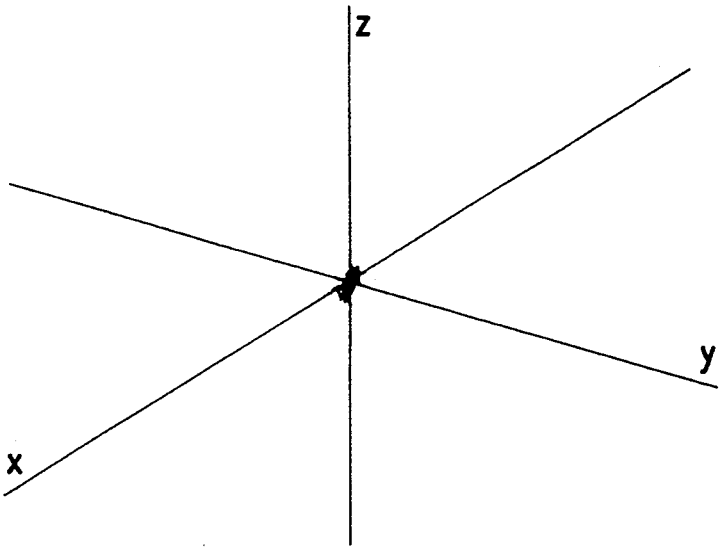
FIG. 17 is a three-dimensional broken line graph showing a three-dimensional phase space of the conventional operation (FIGS. 9(*a*) and 9(*b*)).

In FIG. 16, the X-axis denotes x(t), the y-axis denotes $x(t+\tau)$ and the z-axis denotes $x(t+2\tau)$, and the rotary displacement by the operation method of the present invention mentioned above is shown in a three-dimensional phase space. In FIG. 17, the rotary displacement by the conventional operation method is also shown in a phase space. The drawings show their characteristics such that the conventional operation is cyclic motion and almost fixed movement and the new operation is movement covering a wide area.

Figure 23:
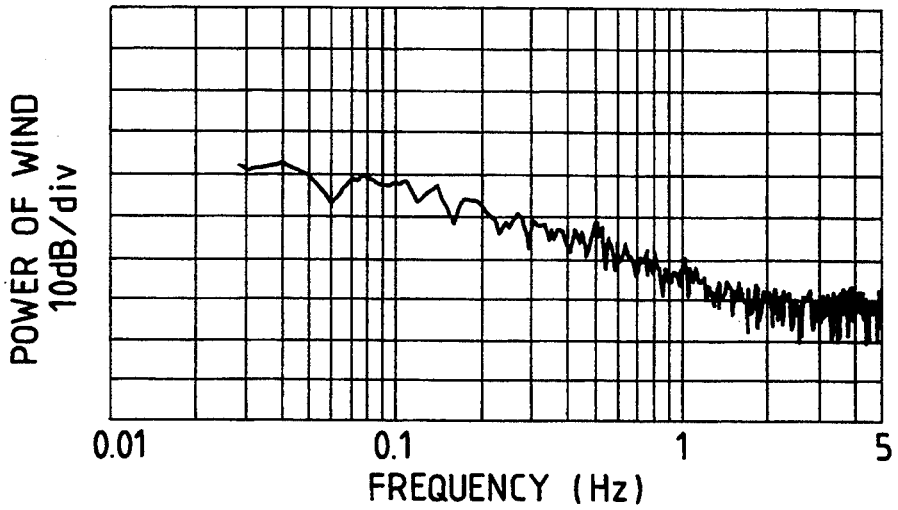
FIG. 23 is a graph showing a power spectrum of a wind on a plateau.
Figure 24:
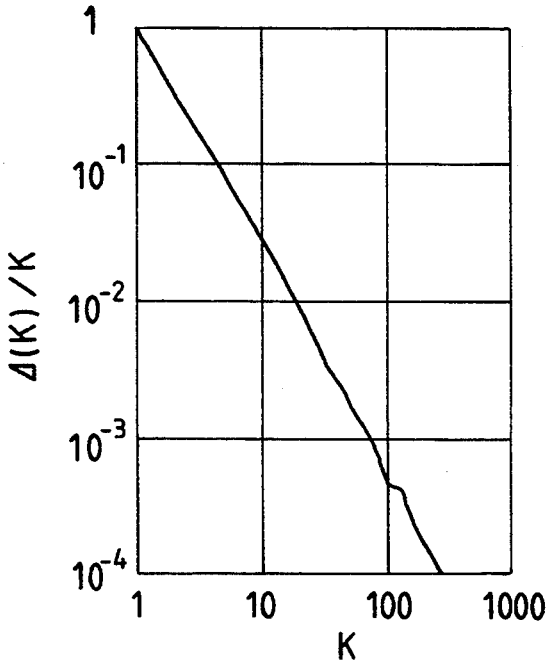
FIG. 24 is a broken line graph showing calculated values of the fractal dimension of wind data.
Figure 25A:
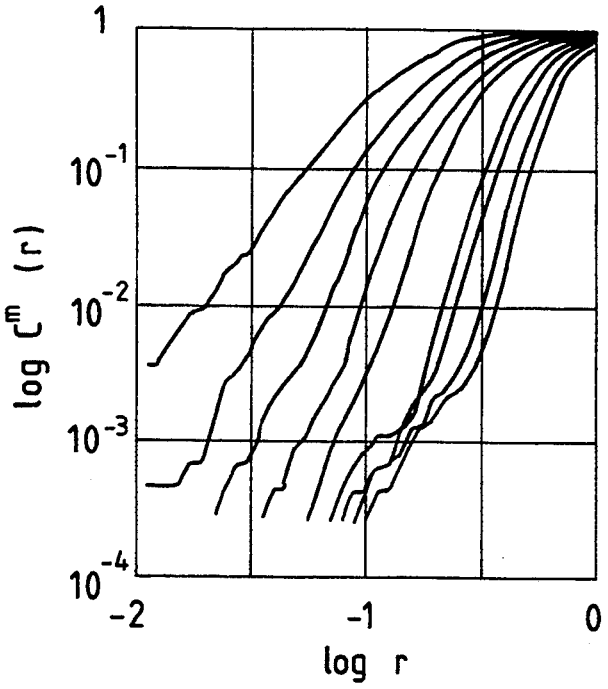
FIGS. 25(*a*) and 25(*b*) are broken line graphs showing calculated values of the correlation index and correlation dimension of wind data.
Figure 25B:
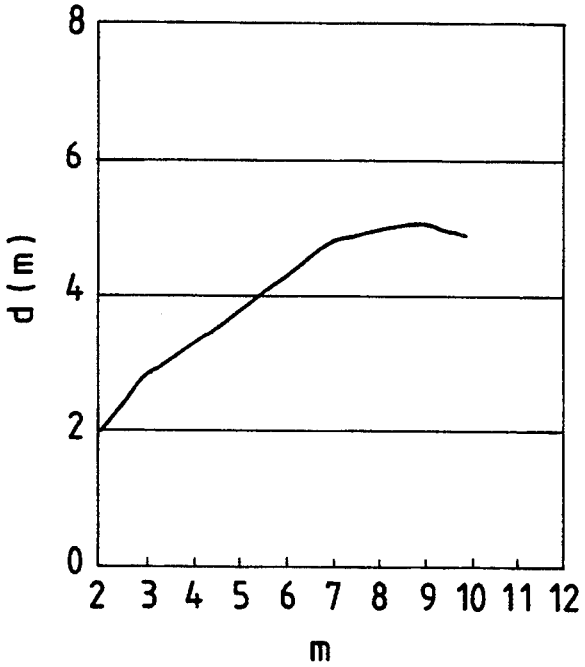

FIG. 23 shows a power spectrum when variations of the wind speed are actually measured on a plateau. In FIG. 24, the fractal dimension is calculated in the same way as in FIG. 14. In FIGS. 25(*a*) and 25(*b*), the correlation dimension is calculated in the same way as in FIGS. 15(*a*) and 15(*b*).

FIG. 23 shows that the fractal dimension ranges from 1.8 to 1.9 or so in a comparatively wide frequency range and FIG. 24 shows that the correlation dimension is about 5.0. When the correlation dimension is compared with the one by the operation method mentioned above, similarity and difference are represented quantitatively.

Figure 9A:
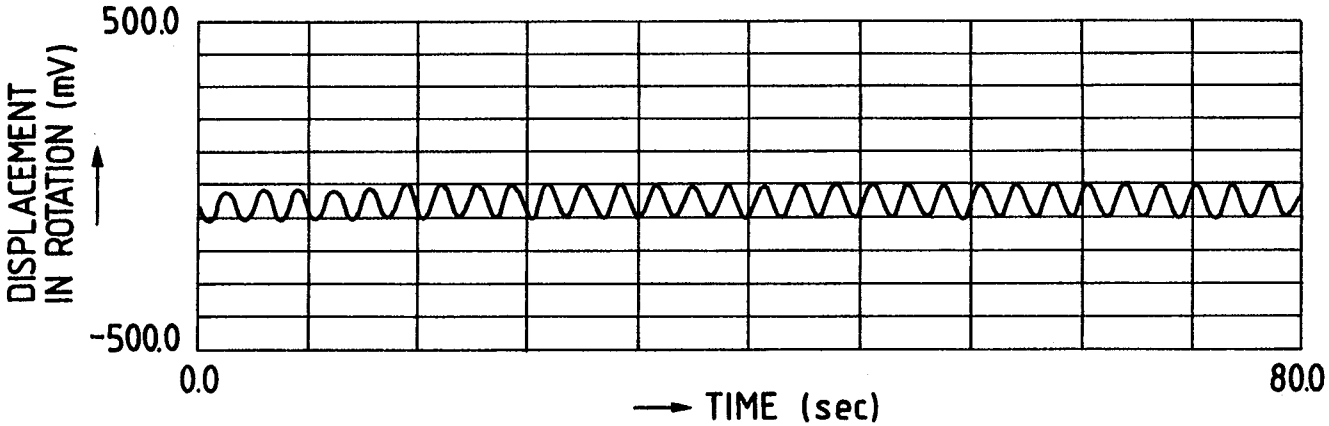
FIGS. 9(*a*) and 9(*b*) show changes with time of the rotational displacement and power spectrum of an impeller by the conventional operation method.
Figure 9B:
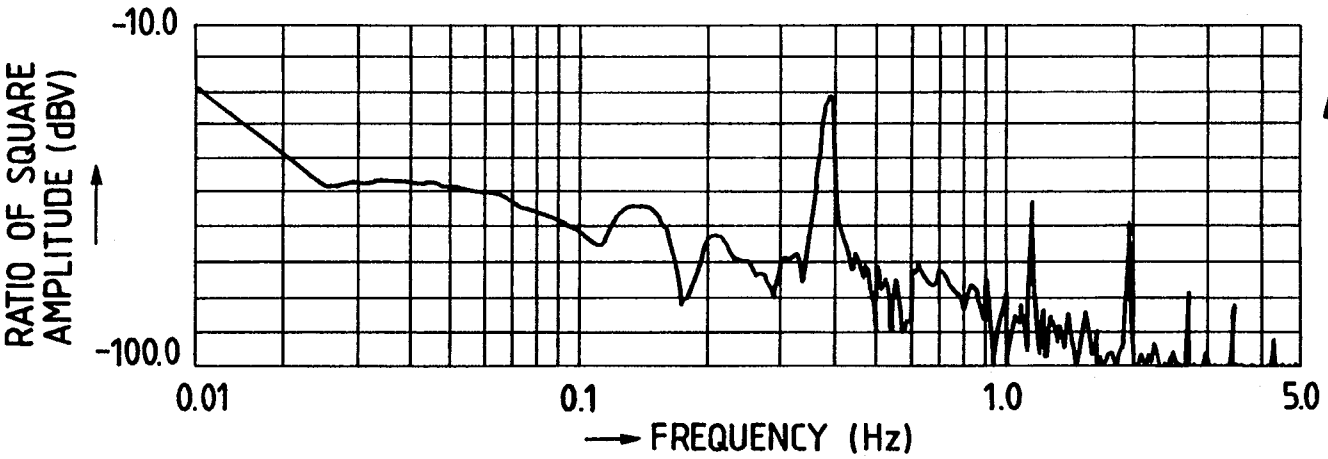
Figure 18A:
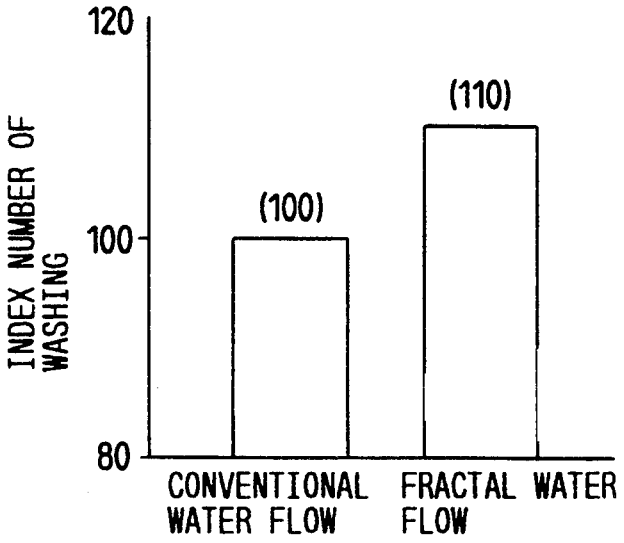
FIGS. 18(*a*) and 18(*b*)are bar graphs showing comparisons of the washing performance and damaging of clothes between the conventional water flow and fractal water flow.
Figure 18B:
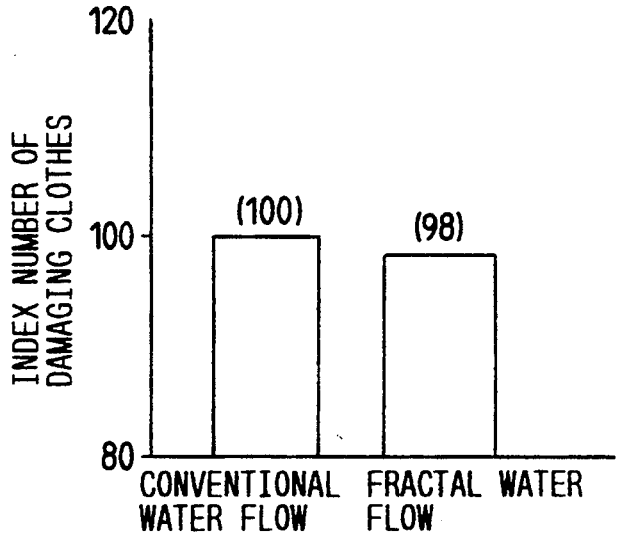

When the washing capacity is compared with the one when large clothes such as a sheet or bath towel are washed at the conventional water flow shown in FIGS. 9(*a*) and 9(*b*) for 12 to 15 minutes, the washing capacity is increased at least 10% under the condition that the damaging of clothes is kept similar to the one at the conventional standard water flow or less as shown in FIG. 18(*b*) and the washing time is shortened to 9 to 12 minutes or so. Furthermore, when control parameters are determined so as to wash lingerie (slip and brassiere), the index number of damaging clothes can be improved to 70 to 80 or so under the condition that the index number of washing is kept at 98 which is close to the one at the conventional standard water flow as shown in FIG. 18(*a*).

This operation control method is not only suited to washing of lingerie made of fine fibers but also adds music elements to noise generated from the motor and washing tub during washing and mechanical noise can be changed to a comfortable sound by improving the noise quality.

The washing resistance of clothes such as dimensional variations, feeling degradation, and discoloration and fading which are caused by washing is affected not only by characters of fibers, threads, and cloth and conditions of processing, dyeing, and sewing but also by external factors such as solvents, temperature, detergents, and mechanical force. Therefore, shrinkable wool products are generally washed by pressing or dry cleaning. This operation control method is also effective in prevention of wool products from shrinking.

Furthermore, to prevent general clothes made of cotton or chemical fibers from shrinking, it is effective to control the mechanical force, so that the water flow in the washing tub is made more natural as if a streamer is washed in the flow of a river. A streamer is required not to get tangled because it is long and washed empirically in a natural stream or brooklet.

By installing a means for detecting the amount of clothes and changing the control parameters of the above control method according to the amount of clothes, operation control for more suitable washing and drying is available. Particularly, by decreasing the reduction rate when the amount of clothes is large or increasing the reduction rate when the amount of clothes is small, the washing rate can be increased rationally according to the amount of clothes.

In the above operation, cloth is one-sided due to unbalance between the end of washing and dehydration and the washing tub may vibrate. When the above operation control of the present invention is applied at least in the latter half of the washing operation, this phenomenon can be moderated.

Figure 19A:
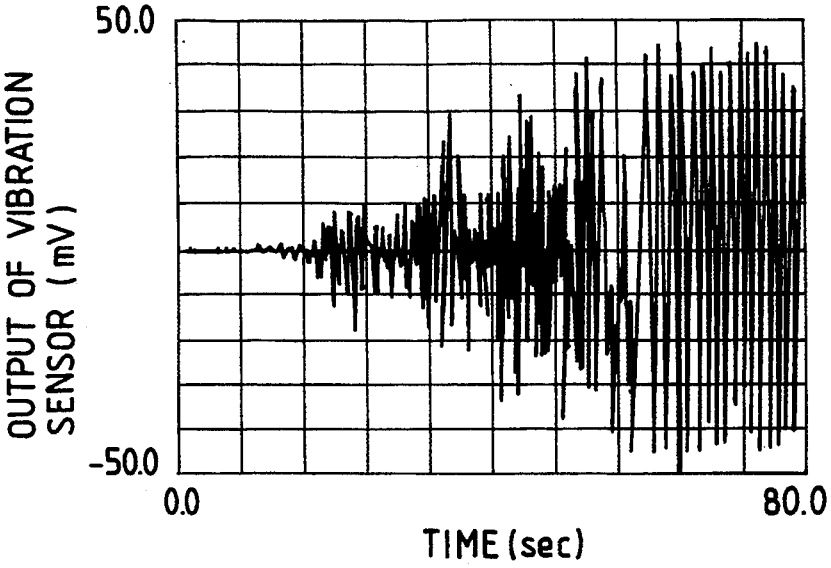
FIGS. 19(*a*) and 19(*b*) are graphs of output vs time showing the output of the vibration sensor during dehydration by the conventional operation.
Figure 19B:
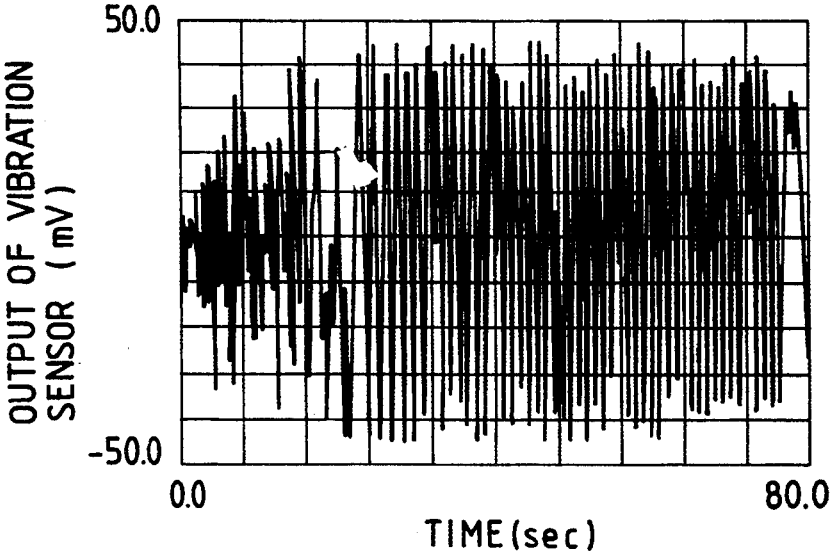
Figure 20A:
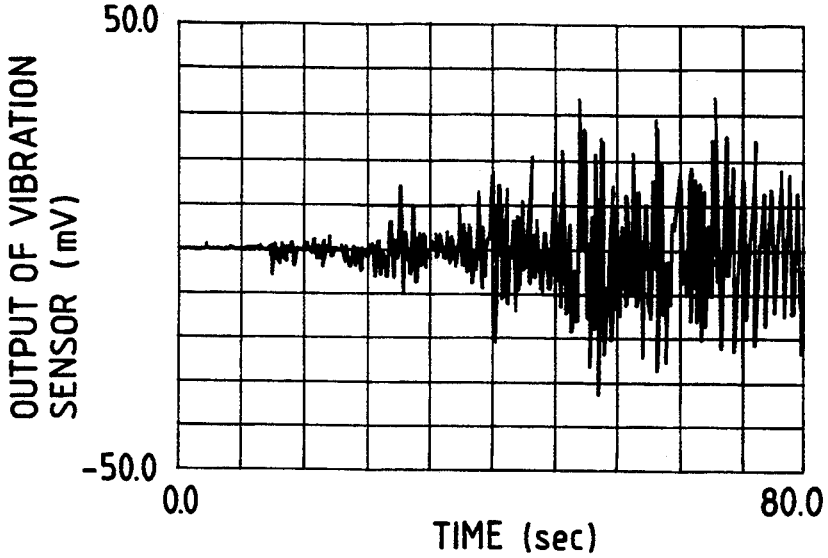
FIGS. 20(*a*) and 20(*b*) are graphs of output vs time showing the output of the vibration sensor during dehydration by the fractal operation.
Figure 20B:
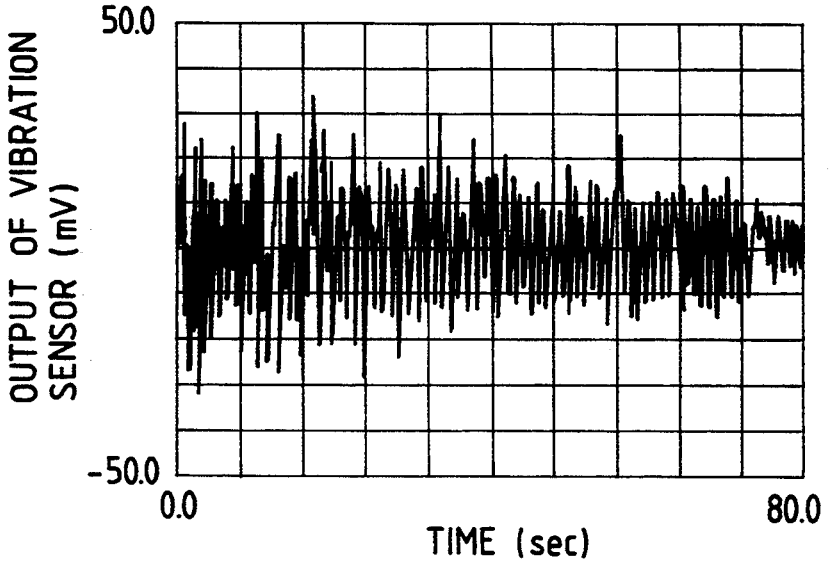
Figure 21A:
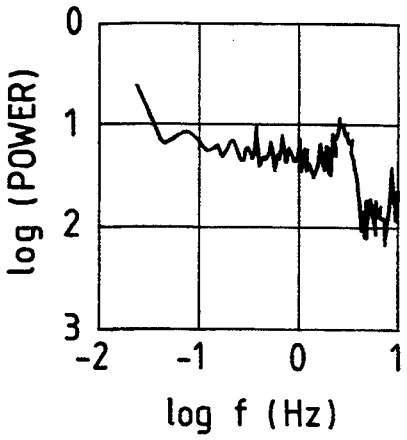
FIGS. 21(*a*) and 21(*b*) are graphs showing power spectra of a whizzing sound of an electric fan by a conventional control unit.
Figure 21B:
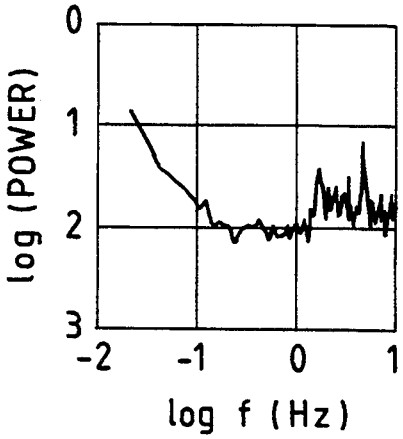
Figure 22:
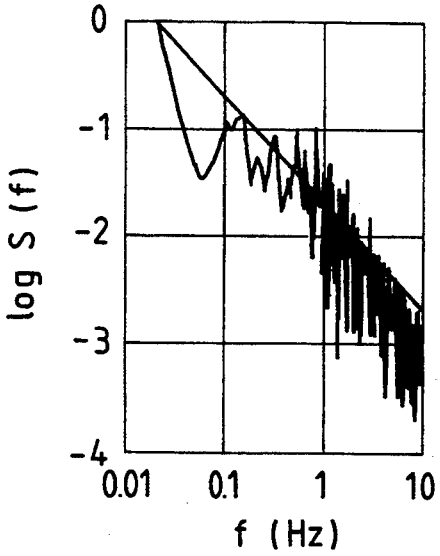
FIG. 22 is a graph showing a power spectrum of a brooklet sound which is one of natural phenomena.

For example, when a vibration sensor is mounted to a washing tub in the conventional operation and dehydration is carried out after the end of washing, the output shown in FIGS. 19(*a*) and 19(*b*) are obtained. FIG. 19(*a*) shows the output of the vibration sensor at the start and FIG. 19(*b*) shows the output of the vibration sensor after the high speed rotation starts. When the output is measured again after the fractal operation is performed, the outputs shown in FIGS. 20(*a*) and 20(*b*) are obtained and the vibration during dehydration can be reduced.

The same operation control method is performed also during rinsing. The same operation control method can be applied to impeller type electric clothes dryers and air conditioning machines.

The rotation speed of a rotating machine is not variable in the above description. However, for example, by adding the rotation speed as one of the control parameters using a frequency variable inverter or DC motor, the complexity increases and the washing condition is desirably brought closer to the natural phenomenon.

Figure 26:
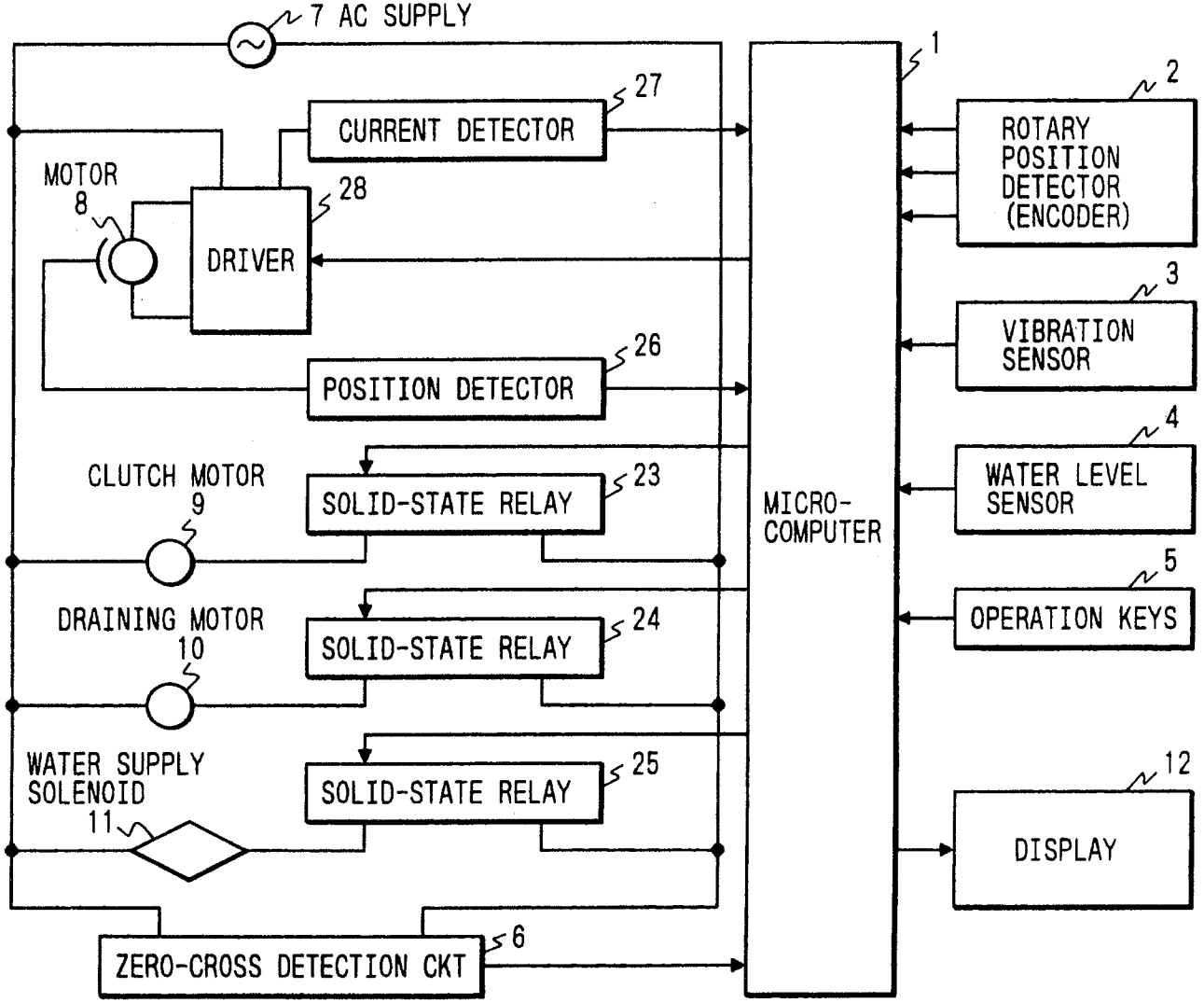
FIG. 26 is a block diagram of a control unit for another washing machine using an inverter motor.

FIG. 26 is a block diagram of a control unit for a washing machine of another embodiment of the present invention using an inverter. The rotary position of a motor 8 is detected by a position detector 26 and the current is detected by a current detector 27 and the signals are sent to a microcomputer 1. The microcomputer 1 sends a speed instruction to a driver circuit 28 from the signals and the motor 8 is driven by the V/F or vector control at a PWM frequency of about 16 kHz. The rotation speed is controlled to 0 to 2400 rpm or so and the torque is controlled to about 20 kg.cm during washing. Therefore, the setting of the control parameters for operating by this operation method is as follows:

(1) Powered rotation angle (length) and reduction rate (ratio 1) for the angle;

(2) Rotation speed (sokudo) and reduction rate (ratio 3) of the rotation speed;

(3) Period (hoji) for holding the rotation speed and reduction ratio (ratio 4) of the time; and (4) Coasting rotation period (teisi) for stopping driving and reduction rate (ratio 2) for the period the washing is performed, as explained above.

The washing condition will be explained in brief hereunder, for example, with reference to FIGS. 6(*a*) to 6(*d*). The motor is controlled so that it is forced to rotate at a speed of, for example, 700 rpm until the rotary angle reaches a count of 17 first, stops for 3 seconds next, and is forced to rotate at a speed of 600 rpm in the reverse direction until the rotary angle reaches a count of 15.

Figure 27:
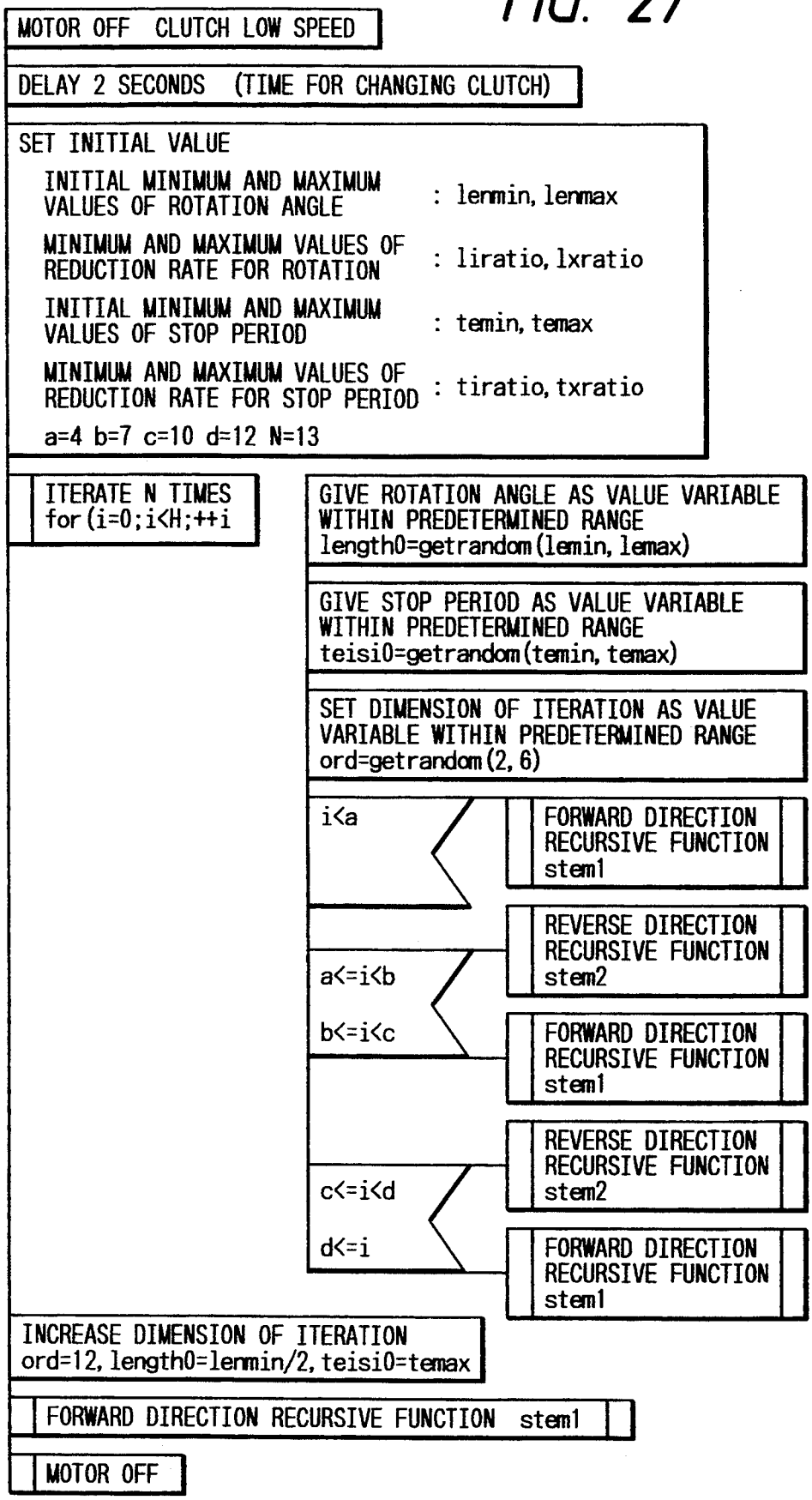
FIG. 27 is a rough PAD diagram (problem analysis diagram) showing another example of the washing operation method of the present invention.
Figure 28:
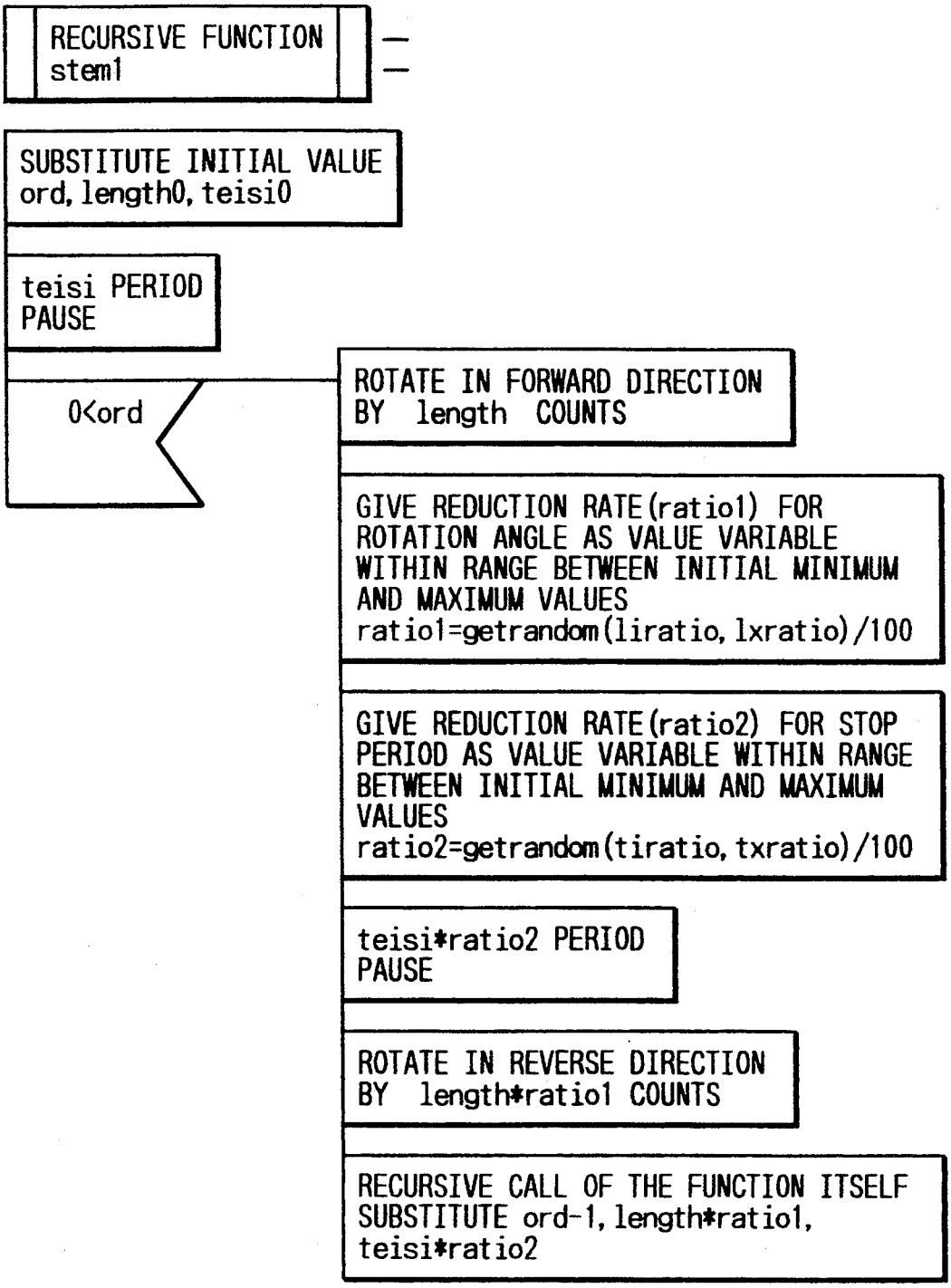
FIG. 28 is a rough PAD diagram of the recursive function used in FIG. 27.

Next, the operation of a washing machine of another embodiment will be explained with reference to the PAD diagrams shown in FIGS. 27 and 28.

(1) It is confirmed that the reduction mechanism is set at Low Speed before starting the motor.

(2) It is necessary to wait for about 2 seconds as a switching time.

(3) The variation range (minimum to maximum) of the initial value of each of the following parameters for controlling the rotation of the impeller is determined:

rotary angle, reduction rate of rotary angle, stop period, reduction rate of stop period.

Simultaneously, the coefficients of iteration (a, b, c, d, N) are determined.

(4) The following values which are to be given to the recursive function as initial values are given as random values by the linear congruent method from the variation ranges in Item (3):

rotary angle (length 0), and stop period (teisi 0).

The dimension (times) of iteration of each recursive function (stem 1) is also given as a random value ranging from 2 to 6 every time.

(5) The operation is iterated by changing the initial rotary direction up to the maximum value (N) so that the following are obtained by the number of operations (i):

i<a: Recursive function in the forward direction; (The rotation starts in the forward direction and ends when the rotary angle is shifted in the forward direction.)

a<=i<b: Recursive function in the reverse direction; (The rotation starts in the forward direction and ends when the rotary angle is shifted in the forward direction.)

b<=i<c: Recursive function in the forward direction;

c<=i<d: Recursive function in the reverse direction; and d<=i: Recursive function in the forward direction.

The coefficients of iteration (a, b, c, d, N) are determined by giving the number of times of iteration of the recursive function in each direction so that it reduces gradually so that the coefficients of iteration are self-similar to the recursive functions which will be described later.

(a, b, c, d, and N may be given as random values.)

(6) In the recursive function in the forward direction, the aforementioned initial values are substituted to the actual rotary angle (length count), stop period (teisi second), and dimension of iteration (ord).

(7) The rotation is stopped for teisi seconds.

(8) The motor rotates in the forward direction until the rotary position detector counts length=length 0.

(9) The reduction rate (ratio 1) of the rotary angle is given as a random value within the variation range in Item (3).

(10) The reduction rate (ratio 2) of the stop period is given as a random value within the variation range in Item (3).

(11) The stop period is reduced and the powered drive is stopped for "teisi*ratio 2" seconds.

(12) The motor rotates in the reverse direction until the rotary position detector counts length*ratio 2 with the rotary angle reduced.

(13) The dimension of iteration (ord) is set to ord-1, and the actual rotary angle (length count) is set to length*ratio 1, and the stop period (teisi second) is set to teisi*ratio 2 and the function itself is called recursively.

(14) Next, the initial comparatively large motion is changed slowly to small motion with a higher dimension until the dimension ord reaches 0 and the operations in Items (7) to (13) are iterated.

(15) In the last washing process, the dimension of iteration (ord) is set to 12 and the motion is made larger than the previous one. Furthermore, the rotary angle is decreased and the stop period is increased. By doing this, cloth is prevented from being one-sided and the vibration during dehydration is reduced.

Figure 29:
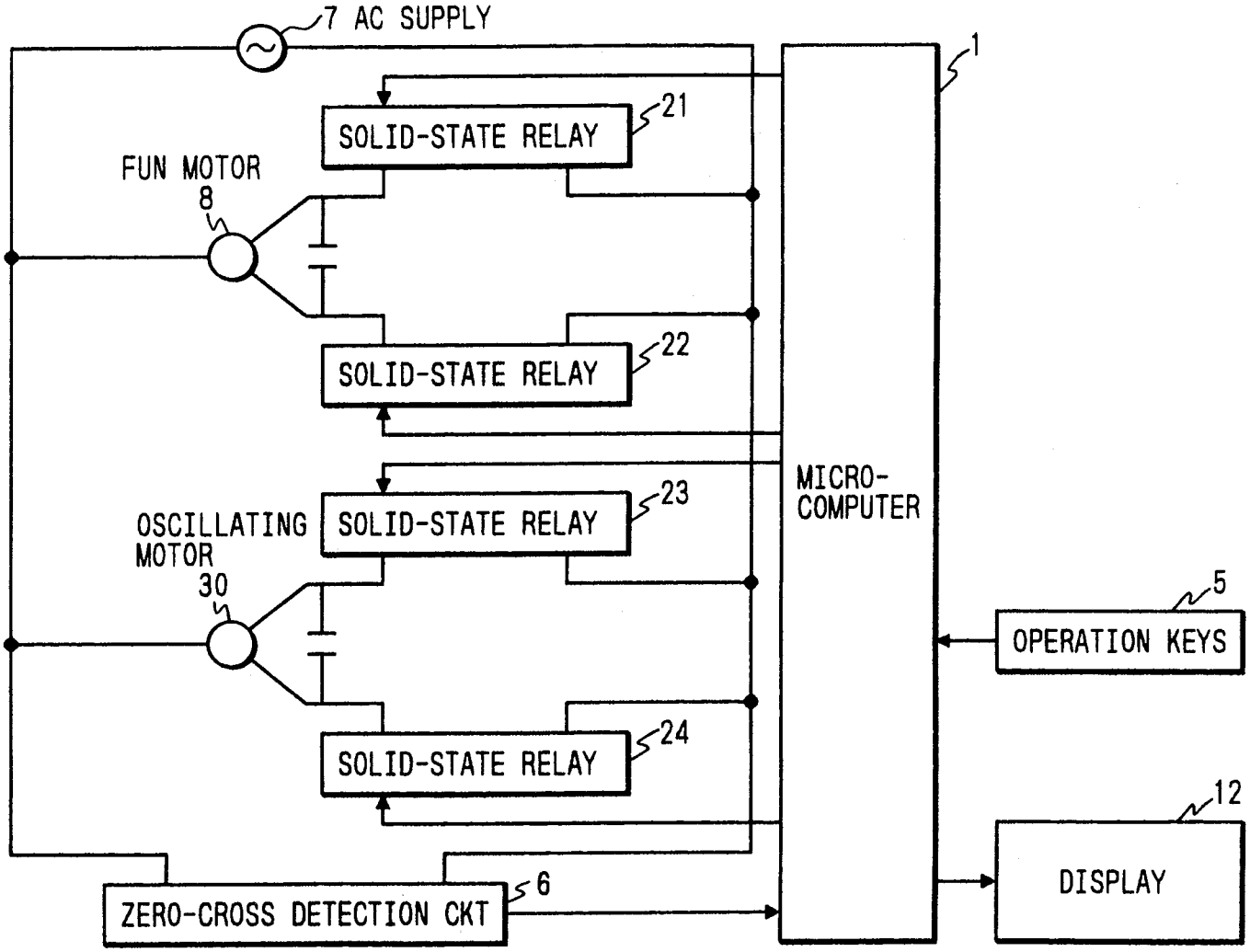

Next, an application example to an electric fan will be explained with reference to FIG. 29. This embodiment is an example that the operation is performed two-dimensionally by controlling a fan motor 8 for changing the amount of a current of air and an oscillating motor 30 for changing the direction of a current of air simultaneously. By setting the control parameters to be operated as follows:

(1) Period for performing powered rotation by driving the fan motor and reduction rate 1 of the period, (2) Period for stopping driving of the fan motor and reduction rate 2 of the period, 10 (3) Period for performing powered rotation of the oscillating motor and reduction rate 3 of the period, and (4) Period for stopping driving of the oscillating motor and reduction rate 4 of the period, the operation is performed by the recursive means and iteration means as described above.

This embodiment can be applied to not only an electric fan but also a fan motor and louver of an air conditioning machine such as an air conditioner. In this case, changes in the amount and direction of a current of air are extremely similar to those of a natural wind, and the thermal diffusion effect increases, and the efficiency of cooling or warming improves.

Next, an application example to a physical amount is shown in FIG. 30. This embodiment shows an example for driving an electric heater 31 using a calorific value as a physical amount. By setting the control parameters to be operated as follows:

(1) Period for supplying power to the electric heater 31 so as to supply a calorific value and reduction rate of the period, and (2) Period for stopping power supply and reduction rate of the period, the operation is performed by the recursive means and iteration means as described above.

FIG. 31 shows another embodiment using a temperature sensor 32 as a means for detecting the physical amount and an A-D converter 33 for supplying the output to the microcomputer 1 in the example shown in FIG. 30. By setting the control parameters to be operated as follows:

(1) Temperature and reduction rate of the temperature as physical amounts, and (2) Period for stopping power supply and reduction rate of the period, the operation is performed by the recursive means and iteration means as described above. As compared with the example shown in FIG. 30, this embodiment is effective in controlling the calorific value finely and surely by making the temperature, which is a control parameter, variable.

Figure 32:
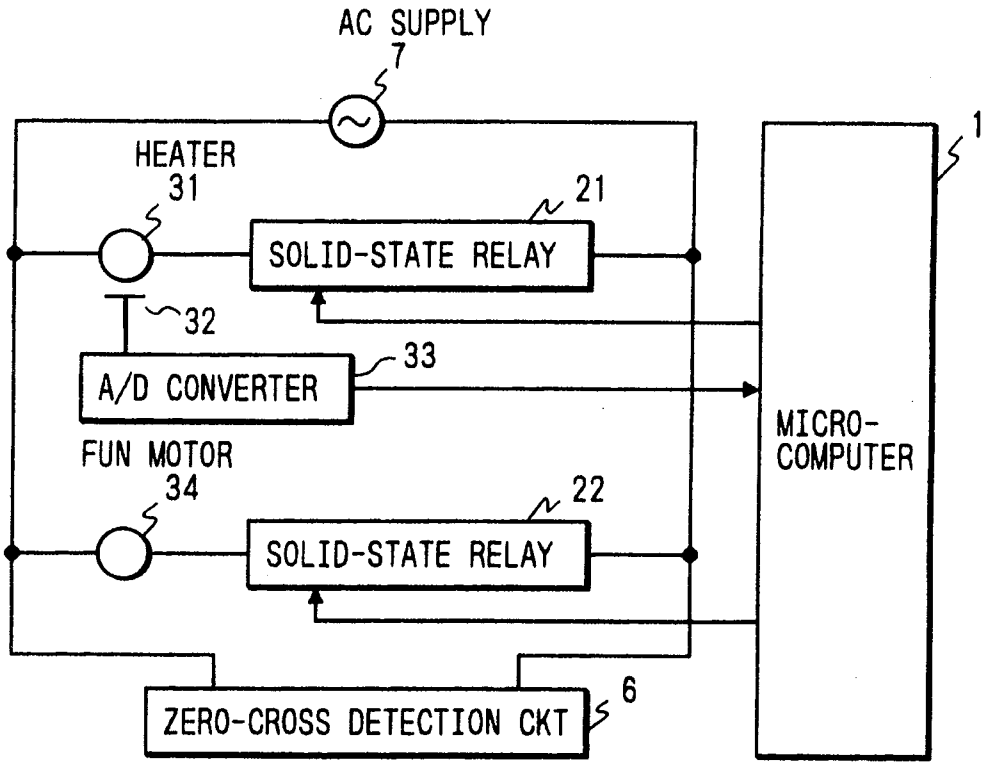
FIG. 32 is a block diagram of another control unit when a fan motor is added to the example shown in FIG. 31 as a control object.

In the embodiments shown in FIGS. 30 and 31, by adding a fan motor furthermore as shown in FIG. 32 and the following parameters:

(1) Period for performing powered rotation by driving the fan motor and reduction rate 1 of the period, and (2) Period for stopping driving of the fan motor and reduction rate 2 of the period, the calorific value changes naturally, and a pleasant feeling, for example, such as warming the body by a bonfire can be obtained, and the performance and efficiency are improved in the same way as with the previous example.

By the control method of the present invention, motion fluctuation and changes in the rotation speed of amenity products and rotating machines have a fractional (self similar) time series and there is a tendency that a particular frequency is enhanced in the inclination of the power spectrum. However, the inclination of the power spectrum is controlled so that the spectral index $\beta$ which is a gradient when the power spectrum is in inverse proportion to the frequency f up to a high frequency (f) which is controllable can be defined with a high correlative coefficient and the aspect is made similar to a phenomenon in the natural world.

The spectral index $\beta$ can be controlled so as to change in correspondence with the object.

Furthermore, when the control method of the present invention is applied to a washing machine, mechanical energy can be given uniformly to washing by a comparatively simple means, and the washing capacity which is the same as that of hand washing using a washboard or of washing in a turbulence or natural river stream can be given to clothes, and uneven washing, twisting and tangling of clothes, and damaging of clothes can be reduced.

What is claimed is:

1. A method of controlling an amenity product or rotating machine comprising the steps of:

deciding values of control parameters according to a fundamental rule which makes power spectra of motion of said amenity product or rotating machine, at least statistically, inversely proportional to frequency of said power spectra, to power of an exponent value;

deciding values of said control parameters recursively according to said fundamental rule; and performing an iteration operation of said amenity product or rotating machine based upon the recursively decided control parameters.

2. A method according to claim 1, wherein said fundamental rule gradually reduces at least one value of said control parameters at a predetermined reduction rate per each occurrence of a recursive decision.

3. A method according to claim 2, wherein said fundamental rule gradually reduces at least one of time related control parameters at a predetermined reduction rate.

4. A method according to claim 1, further comprising the step of:

detecting a rotated angle of said amenity product or rotating machine, wherein the iteration step is performed by using an angle for performing powered rotation and a period for performing coasting rotation as control parameters, and wherein said fundamental rule gradually reduces said angle at a first reduction rate and said period at a second reduction rate.

5. A method according to claim 1, further comprising the step of:

storing the decided values and the recursively decided values of said control parameters, wherein the iteration step is performed according to the stored control parameters.

6. A method according to claim 1, further comprising the step of:

detecting a rotated angle of said amenity product or rotating machine, wherein the iteration step is performed by using a first angle for performing powered rotation and a second angle for performing coasting rotation as control parameters, and wherein said fundamental rule gradually reduces said first angle at a first reduction rate and said second angle at a second reduction rate.

7. A method according to claim 6, wherein the values of the control parameters are decided recursively according to a basic algorithm for creating the powered rotation angle in the forward direction first, the coasting rotation angle next, and then the powered rotation angle in a reverse direction, one by one.

8. A method according to claim 1, wherein a plurality of motors are operated according to said control parameters, and wherein said fundamental rule reduces at least one of said control parameters slowly at a predetermined reduction rate.

9. A method according to claim 8, wherein said plurality of motors consist of an electric fan motor and a reversible motor, wherein said control parameters are a powered rotation period for said fan motor, a coasting rotation period for stopping driving of said fan motor, a powered rotation period for said reversible motor, and a coasting rotation period for stopping driving of said reversible motor, and wherein said fundamental rule gradually reduces the powered rotation period for said fan motor at a first reduction rate, the coasting rotation period for said fan motor at a second reduction rate, the powered rotation period for said reversible motor at a third reduction rate, and the coasting rotation period for said reversible motor at a fourth reduction rate.

10. A method according to claim 1, wherein said control parameters are a period for supplying at least one physical amount selected from a calorific value, a temperature value, an amount of a current of air, an amount of stimulus of massage, and a period for stopping the supply, and wherein said fundamental rule gradually reduces said period for supplying at a first reduction rate and said period for stopping the supply at a second reduction rate.

11. A method according to claim 10, further comprising the step of:

detecting said at least one physical amount, wherein said control parameters are a magnitude of said at least one physical amount and the period for stopping the supply of said at least one physical amount, wherein said fundamental rule gradually reduces said magnitude at a third reduction rate and said period for stopping the supply of physical amount at a second reduction rate.

12. A method according to claim 1, wherein said control parameters are a period for supplying power to an electric heater so as to supply a calorific value, a period for stopping a power supply to an electric heater, a period for driving and forcibly rotating a fan motor, and the period for stopping driving of said fan motor, and wherein said fundamental rule gradually reduces the period for supplying power to the electric heater at a first reduction rate, the period for stopping the power supply to the electric heater at a second reduction rate, a powered rotation period for said fan motor at a third reduction rate, and the period for stopping driving of said fan motor at a fourth reduction rate.

13. A method of controlling an amenity product or rotating machine comprising the steps of:

deciding values of control parameters according to a fundamental rule;

deciding values of said control parameters recursively according to said fundamental rule; and performing an iteration operation of said amenity product or rotating machine based upon the recursively decided control parameters, wherein the iteration step is performed by using a first period for performing powered rotation and a second period for performing coasting rotation as control parameters, and wherein said fundamental rule gradually reduces said first period at a first reduction rate and said second period at a second reduction rate.

14. A method according to claim 13, wherein the values of the control parameters are decided recursively according to a basic algorithm for creating the powered rotation period in the forward direction first, the coasting rotation period next, and then a reverse direction powered rotation period, one by one.

15. A method of controlling a washing machine according to claim 14, wherein said basic algorithm comprises a first basic algorithm and a second basic algorithm, said first basic algorithm deciding the powered rotation angle in the forward direction first, the coasting rotation period next, and then the powered rotation angle in the reverse direction, and said second basic algorithm deciding the powered rotation angle in the reverse direction first, the coasting rotation period next, and then the powered rotation angle in the forward direction, and wherein each occurrence of said iteration step is performed by an operation based upon the first basic algorithm and an operation based upon the second basic algorithm iterated alternately therewith.

16. A method according to claim 14, wherein said basic algorithm comprises a first basic algorithm and a second basic algorithm, said first basic algorithm deciding the powered rotation period in the forward direction first, the coasting rotation period next, and then the powered rotation period in a reverse direction, and said second basic algorithm deciding the powered rotation period in the reverse direction first, the coasting rotation period next, and then the powered rotation period in the forward direction, and wherein each occurrence of said iteration step is performed by an operation based upon the first basic algorithm and an operation based upon the second basic algorithm iterated alternately therewith.

17. A method according to claim 14, wherein said basic algorithm comprises a first basic algorithm and a second basic algorithm, said first basic algorithm deciding the powered rotation angle in the forward direction first, the coasting rotation period next, and then the powered rotation angle in the reverse direction, and said second basic algorithm deciding the powered rotation angle in the reverse direction first, the coasting rotation period next, and then the powered rotation angle in the forward direction, and wherein each occurrence of iteration step is performed by an operation based upon the first basic algorithm and an operation based upon the second basic algorithm iterated alternately therewith.

18. A method according to claim 13, wherein the values of the control parameters are decided recursively according to a basic algorithm for creating a powered rotation angle in the forward direction first, the coasting rotation angle next, and then the powered rotation angle in a reverse direction, one by one.

19. A method of controlling an amenity product or rotating machine comprising the steps of:

deciding values of control parameters according to a fundamental rule;

deciding values of said control parameters according to said fundamental rule which slowly reduces at least one value of said control parameters at a predetermined reduction rate per each occurrence of a recursive decision; and performing an iteration operation of said amenity product or rotating machine based upon the recursively decided control parameters, wherein at least one of said control parameters, the reduction rate thereof, and number of times the iteration step occurs is set as a random amount varying within a predetermined range.

20. An operation control method of an electric washing machine or impeller type electric clothes dryer for washing or drying clothes by rotating an impeller, agitator, or drum, according to claim 19, further comprising the steps of:

controlling a powered rotation period of said impeller, agitator, or drum and a drive stopping period thereof; and controlling said powered rotation period by a reduction rate for reducing it and deciding the powered rotation period recursively.

21. An operation control method of an electric washing machine or impeller type electric clothes dryer for washing or drying clothes by rotating an impeller, agitator, or drum and by controlling a powered rotation angle according to claim 19, further comprising the steps of:

controlling a powered rotation angle and a coasting rotation angle of said impeller, agitator, or drum; and controlling said powered rotation angle by a reduction rate for reducing it and deciding a powered rotation period recursively.

22. A method according to claim 19, further comprising the step of:

storing the decided values and the recursively decided values of said control parameters, wherein the iteration step is performed according to the stored control parameters.

23. An operation control method of an electric washing machine or impeller type electric clothes dryer for washing or drying clothes by rotating an impeller, agitator, or drum and by controlling the powered rotation angle, said method comprising the steps of:

deciding at least a powered rotation angle according to a fundamental rule which makes power spectra of at least said powered rotation angle, at least statistically, inversely proportional to the frequency of said power spectra, to the power of a spectral index value;

controlling the powered rotation angle and a coasting rotation period of at least one of said impeller, agitator, or drum; and reducing at least said powered rotation angle gradually at a predetermined reduction rate and deciding the powered rotation angle recursively.

24. An operation control method according to claim 23, wherein the control step further comprises: a step of creating at least one of said powered rotation angle, coasting rotation period, the reduction rate of the powered rotation angle, a reduction rate of the coasting rotation period, and a number of times of recursive iteration as a random amount which varies within a predetermined range.

25. An operation control method according to claim 24, further comprising the step of:

detecting the amount of clothes before starting washing, wherein at least one of said powered rotation angle, said coasting rotation period, the reduction rate of the powered rotation angle by said recursive control means, the reduction rate of the coasting rotation period, and the number of times of occurrence of iteration is changed according to the amount of clothes.

26. An operation control method according to claim 23, wherein the control step further comprises: a basic algorithm for creating the powered rotation angle in a forward direction first, the coasting rotation period next, and then a powered rotation angle in a reverse direction, one by one.

27. An operation control method according to claim 23, further comprising the step of:

detecting the amount of clothes before starting washing, wherein when the amount of clothes is large, said predetermined reduction rate is reduced and when the amount of clothes is small, said predetermined reduction rate is increased.

28. An operation control method according to claim 23, wherein the operation control method of said electric washing machine or impeller type clothes dryer is performed at least in the latter half of the washing or drying operation.

29. An operation control method according to claim 23, wherein in said control step, an operation by a first basic algorithm and an operation by a second basic algorithm are iterated alternately at each occurrence of said iteration step, said first basic algorithm deciding the powered rotation angle and the coasting rotation period in the forward direction and a powered rotation angle in a reverse directions, one by one, and said second basic algorithm deciding a powered rotation angle and a coasting rotation period in the reverse direction and the powered rotation angle in the forward direction, one by one.

* * * * *